US009848740B2

(12) United States Patent
McDonald et al.

(10) Patent No.: US 9,848,740 B2
(45) Date of Patent: Dec. 26, 2017

(54) SHOWER STORAGE SYSTEMS

(71) Applicant: Kohler Co., Kohler, WI (US)

(72) Inventors: Alan T. McDonald, Sheboygan, WI (US); Sarah K. O'Brien, Sheboygan, WI (US); Luke B. Zimbric, Sheboygan Falls, WI (US); Timothy J. Williams, Port Washington, WI (US); Kyle A. Marten, Sheboygan Falls, WI (US); Gurusiddeshwar Gudimani, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 90 days.

(21) Appl. No.: 14/969,403

(22) Filed: Dec. 15, 2015

(65) Prior Publication Data

US 2016/0166119 A1 Jun. 16, 2016

Related U.S. Application Data

(60) Provisional application No. 62/092,393, filed on Dec. 16, 2014.

(51) Int. Cl.

| | |
|---|---|
| ***A47K 3/00*** | (2006.01) |
| ***A47K 3/28*** | (2006.01) |
| ***A47K 3/40*** | (2006.01) |

(52) U.S. Cl.

CPC ..... *A47K 3/281* (2013.01); *A47K 3/003* (2013.01); *A47K 3/40* (2013.01); *A47K 3/283* (2013.01)

(58) Field of Classification Search

CPC ..... A47K 3/281; A47K 3/283

USPC ..... 4/614

See application file for complete search history.

(56) References Cited

U.S. PATENT DOCUMENTS

| | | | | |
|---|---|---|---|---|
| 2,036,184 | A * | 4/1936 | Armstrong | A47B 81/002 108/101 |
| 4,109,426 | A * | 8/1978 | Dobija | A47K 3/001 4/584 |
| 7,028,349 | B2 * | 4/2006 | Helmetsie | A47K 3/281 4/596 |
| D618,772 | S * | 6/2010 | Hoernig | D23/283 |
| 8,096,000 | B2 | 1/2012 | Helmetsie et al. | |

OTHER PUBLICATIONS

Canadian Office Action issued in corresponding application No. 2,915,193 dated Sep. 29, 2016.

* cited by examiner

*Primary Examiner* — Huyen Le

(74) *Attorney, Agent, or Firm* — Foley & Lardner LLP

(57) ABSTRACT

A storage system for a shower enclosure includes a first wall member, a second wall member, and a storage accessory. The first wall member includes a corner defining a recessed portion. The first wall member further includes a corner notch disposed along the corner within the recessed portion, and a first side notch disposed along an inner side surface of the first wall member adjacent the recessed portion. The second wall member is coupled to the first wall member at an end of the corner adjacent the recessed portion and is oriented perpendicular to the first wall member. The second wall member includes a second side notch disposed along an inner side surface of the second wall member. The storage accessory is removably coupled between the first wall member and the second wall member at the corner notch, the first side notch, and the second side notch.

20 Claims, 20 Drawing Sheets

SHOWER STORAGE SYSTEMS

CROSS-REFERENCE TO RELATED PATENT APPLICATIONS

This application claims the benefit of and priority to U.S. Provisional Application No. 62/092,393, filed Dec. 16, 2014, the entire disclosure of which is incorporated by reference herein.

BACKGROUND

The present application relates generally to shower and bathing enclosures, and in particular, to adaptable storage systems for shower and bathing enclosures.

Generally speaking, a shower or bathing area can include one or more wall members coupled together to define a shower or bathing enclosure. One or more of the wall members can include integrated storage areas, such as recesses, openings, or shelves, for storing various bathing accessories therein (e.g., soap, shampoo bottles, loofahs, wash cloths, etc.). Typically, the storage areas are fixed within the wall members and are not adaptable or reconfigurable to allow for different storage solutions, such as different locations, different types of storage members, or the like.

Accordingly, it would be advantageous to provide a wall member for a shower or bathing enclosure that includes features that allow for adaptable or reconfigurable storage solutions. These and other advantageous features will become apparent to those reviewing the present disclosure.

SUMMARY

One embodiment relates to a storage system for a shower enclosure including a first wall member, a second wall member, and an accessory. The first wall member includes a corner defining a recessed portion. The first wall member further includes a corner notch disposed along the corner within the recessed portion, and a first side notch disposed along an inner side surface of the first wall member adjacent the recessed portion. The second wall member is coupled to the first wall member at an end of the corner adjacent the recessed portion and is oriented perpendicular to the first wall member. The second wall member includes a second side notch disposed along an inner side surface of the second wall member. The accessory is removably coupled between the first wall member and the second wall member at the corner notch, the first side notch, and the second side notch.

Another embodiment relates to a shower enclosure including a back wall panel and a side wall panel. The back wall panel includes a corner defining a recessed portion. The back wall panel further includes a plurality of corner notches stacked vertically along the corner within the recessed portion, and a plurality of first side notches stacked vertically along an inner side surface of the back wall panel adjacent the recessed portion. The side wall panel is coupled to the back wall panel at an end of the corner adjacent the recessed portion and is oriented perpendicular to the back wall panel. The side wall panel includes a plurality of second side notches stacked vertically along an inner side surface of the side wall panel adjacent the recessed portion. The plurality of corner notches, the plurality of first side notches, and the plurality of second side notches collectively define a plurality of separate installation zones configured to receive an accessory.

Yet another embodiment relates to a storage system for a shower enclosure including a back wall panel, a side wall panel, and an accessory. The back wall panel includes a perpendicular corner defining a recessed portion. The back wall panel further includes a corner notch disposed along the corner within the recessed portion, and a first side notch disposed along an inner side surface of the back wall panel adjacent the recessed portion. The side wall panel is coupled to the back wall panel at an end of the corner adjacent the recessed portion and is oriented perpendicular to the back wall panel. The side wall panel includes a second side notch disposed along an inner side surface of the side wall panel opposite the first side notch. The accessory is removably coupled between the back wall panel and the side wall panel at the corner notch, the first side notch, and the second side notch.

DETAILED DESCRIPTION

Referring generally to the FIGURES, disclosed herein are adaptable storage systems for showers or baths that are configured to receive a variety of different accessories, such as receptacles, shelves, cabinets, support ledges, grab bars, or the like. The adaptable storage systems can, advantageously, allow a designer, a user, or an installer to selectively adjust the position of various accessories within the storage system or to install/remove accessories to/from the storage system to reconfigure the shower or bathing area. According to various exemplary embodiments, the storage systems are integrated into (i.e., integrally formed with) one or more wall panels of a shower or bathing enclosure.

Figure 1A:
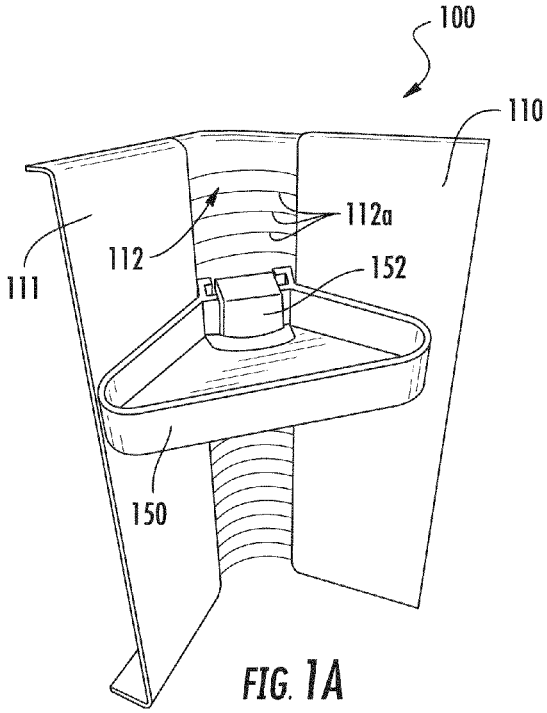
FIGS. 1A-1B are partial perspective views of an adaptable storage system for a shower or bathing enclosure according to an exemplary embodiment.
Figure 1B:
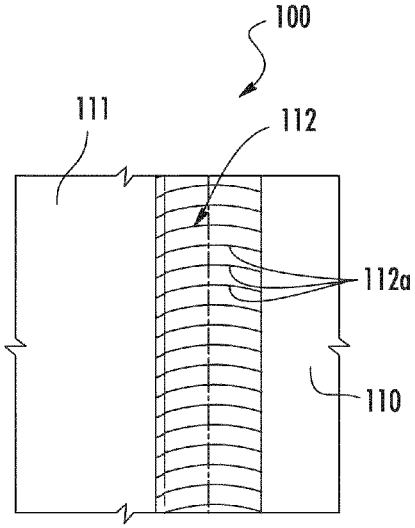

Referring to FIGS. 1A-1B, a storage system 100 is shown according to an exemplary embodiment. The storage system 100 includes a first wall panel 110 (e.g., first wall member, etc.) and a second wall panel 111 (e.g., second wall member, etc.) coupled together to define part of a shower or bathing enclosure. In this embodiment, the first and second wall panels 110 and 111 are arranged perpendicular to each other to form a corner of the enclosure. The two wall panels 110 and 111 are coupled together using any assembly features and methods known to those having skill in the art. According to the exemplary embodiment shown, the first and second wall panels 110 and 111 form a seam represented by a dashed line at the corner of where the two wall members meet. According to other exemplary embodiments, the corner section is integrally formed to include portions of the first and second wall panels 110 and 111, to thereby provide a seamless appearance at the corner of the enclosure.

As shown in FIGS. 1A-1B, each of the first and second wall panels 110 and 111 includes a concave or recessed portion (e.g., a niche, etc.) that cooperatively defines an installation area 112. The installation area 112 has a generally concave shape extending along a longitudinal direction at the corner where the first and second wall panels 110 and 111 are joined together. According to an exemplary embodiment, the installation area 112 includes one or more ribs or undulations 112*a* (e.g., peaks and valleys, ribs, etc.) defining separate installation zones for receiving an accessory thereon (e.g., a shelf, a receptacle, a grab bar, a frame, etc.). As shown in FIG. 1A, an accessory shown as a receptacle 150 is coupled to the installation area 112 at one or more of the undulations 112*a*. The undulations 112*a* are spaced apart equidistant from each other and are oriented horizontally and arranged in a vertically stacked configuration to define a plurality of installation levels or zones. The undulations 112*a* collectively define a track extending along a longitudinal direction at the corner between the first and second wall panels 110 and 111. According to an exemplary embodiment, the installation area 112 extends along at least a portion or all of the height of the first and second wall panels 110 and 111.

According to an exemplary embodiment, the second wall panel 111 forms part of a back wall of the shower or bathing enclosure. The back wall can include a second wall panel (not shown) stacked on top of the wall panel 111 to collectively define the entire back wall of the enclosure. That is to say, the back wall can be split along a horizontal direction into two wall panels, one of which being wall panel 111. Furthermore, the split wall configuration allows a user or an installer to easily move or transport the wall panel sections to, for example, an installation site. According to various exemplary embodiments, each of the first and second wall panels 110 and 111 is made from a semi-rigid or a rigid material suitable for use in a shower or bathing environment. According to an exemplary embodiment, the first and second wall panels 110 and 111 are made from a thermoset material commercially available under the trade name Vikrell.

Figure 2A:
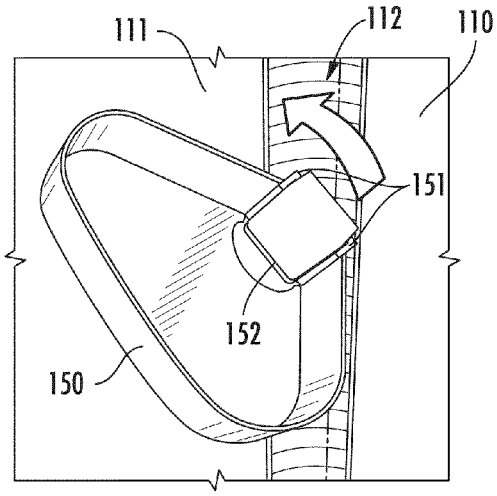
FIGS. 2A-2B illustrate an assembly sequence for an accessory in the adaptable storage system of FIGS. 1A-1B according to an exemplary embodiment.
Figure 2B:
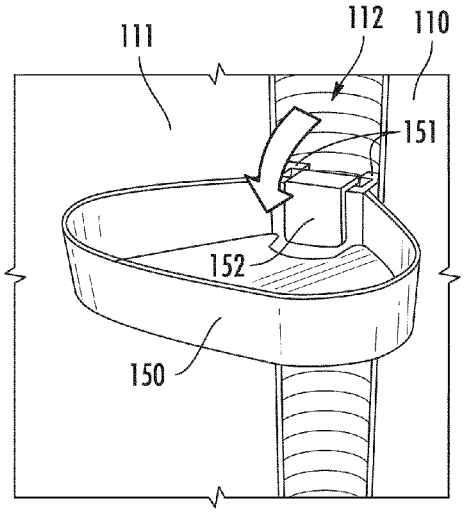

Referring now to FIGS. 2A-2B, an installation sequence for an accessory 150 in the storage system of FIGS. 1A-1B is shown according to an exemplary embodiment. In this exemplary embodiment, the accessory 150 is a receptacle, although it is appreciated that the accessory 150 may be configured as another type of accessory for a shower or bathing environment, such as a shelf or other type of accessory, according to other exemplary embodiments. The accessory 150 includes a latch 152 configured to selectively lock the accessory 150 into place along the installation area 112. The latch 152 is also configured to selectively unlock the accessory 150 for removal from the installation area 112. The accessory 150 includes a pair of tabs 151 that are each configured to engage one or more undulations 112*a* of the installation area 112. The tabs 151 are configured to flex (e.g., deflect, move, elastically deform, etc.) to selectively engage at least a portion of the installation area 112. According to an exemplary embodiment, the latch 152 is configured to apply an outward force to the tabs 151, such that the tabs 151 flex or deflect outwardly away from the accessory 150 to engage one or more of the undulations 112*a*, to thereby set a longitudinal position of the accessory 150 along the installation area 112.

For example, referring to FIG. 2A, the accessory 150 is shown in an unlocked state, disengaged from the installation area 112. In this state, a user or an installer can rotate the accessory 150 into the installation area 112, as represented by the arrow in FIG. 2A. The user or the installer can determine a suitable position for the accessory 150 along the ribbed track defined by the undulations 112*a*. Referring now to FIG. 2B, once a desired position for the accessory 150 is determined, the user or the installer can set the position of the accessory 150 relative to the installation area 112 by moving the latch 152 into a locked position. For example, the latch 152 is configured to be rotated by a user in the direction indicated generally by the arrow in FIG. 2B in a downward direction to set the position of the accessory 150 relative to the installation area 112. When the latch 152 is moved/rotated downward to the locked position, a portion of the latch 152 applies an outward force to the tabs 151, such that the tabs 151 flex or deflect outwardly to engage one or more of the undulations 112*a* of the installation area 112. In this manner, a longitudinal position of the accessory 150 within the installation area 112 can be set. According to an exemplary embodiment, the user or the installer can easily unlock the latch 152 by rotating the latch 152 in a direction opposite to the direction indicated by the arrow in FIG. 2B. The user can selectively move the accessory 150 to a different longitudinal position along the installation area 112. In this way, the installation area 112 provides for flexibility to create custom storage configurations (e.g., different accessory locations, etc.), and also provides for accessibility for maintenance or repair (e.g., cleaning of the installation area 112 or the accessories, replacing accessories, etc.).

Figure 3:
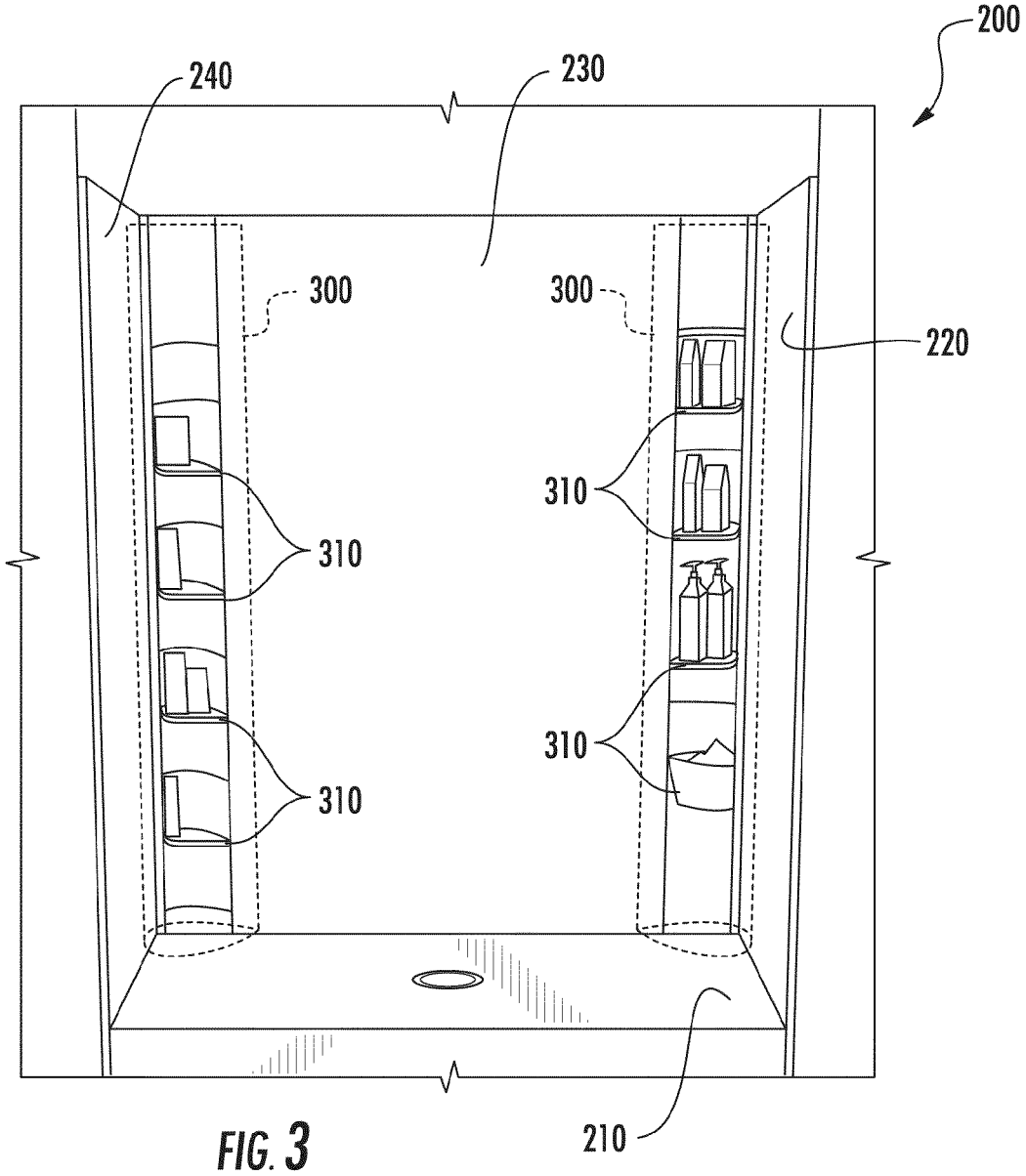
FIG. 3 is a perspective view of an adaptable storage system for a shower or bathing enclosure according to another exemplary embodiment.
Figure 4A:
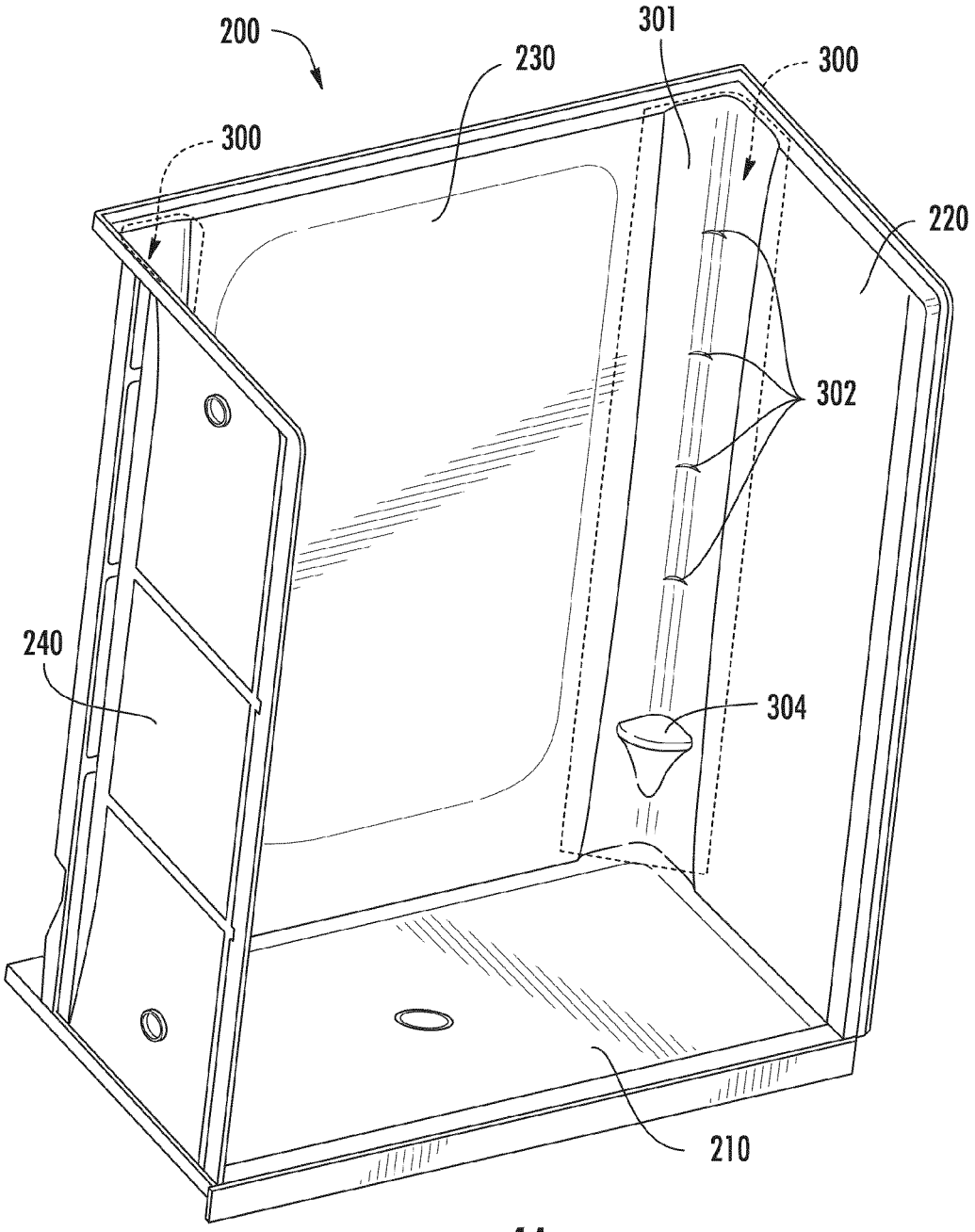
FIG. 4A is a perspective view of the adaptable storage system of FIG. 3 without any accessories installed therein.
Figure 4B:
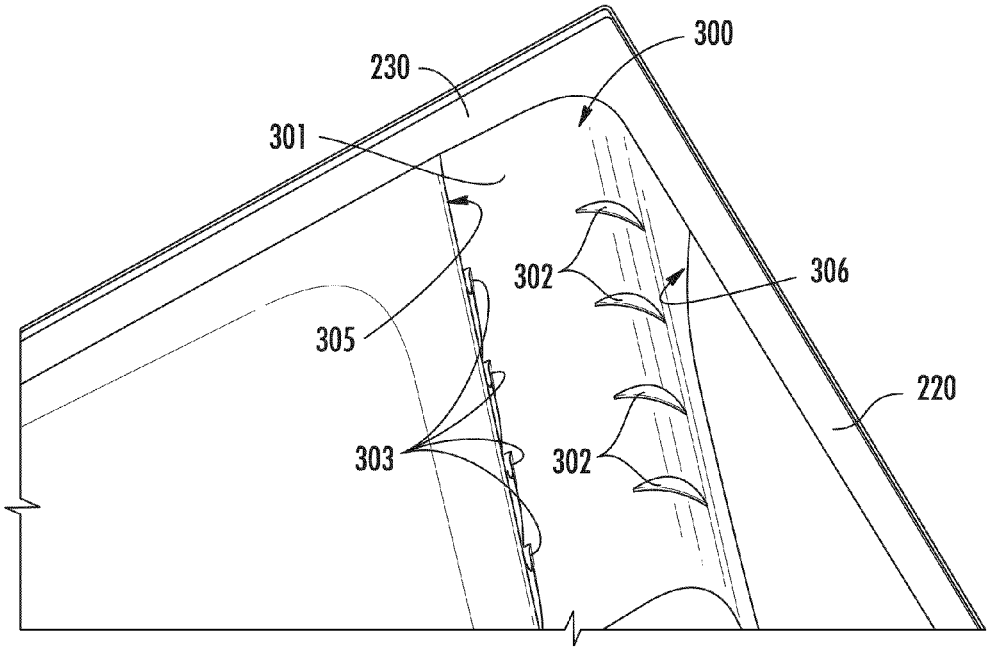
FIG. 4B is a partial perspective view of the adaptable storage system of FIG. 4A.
Figure 4C:
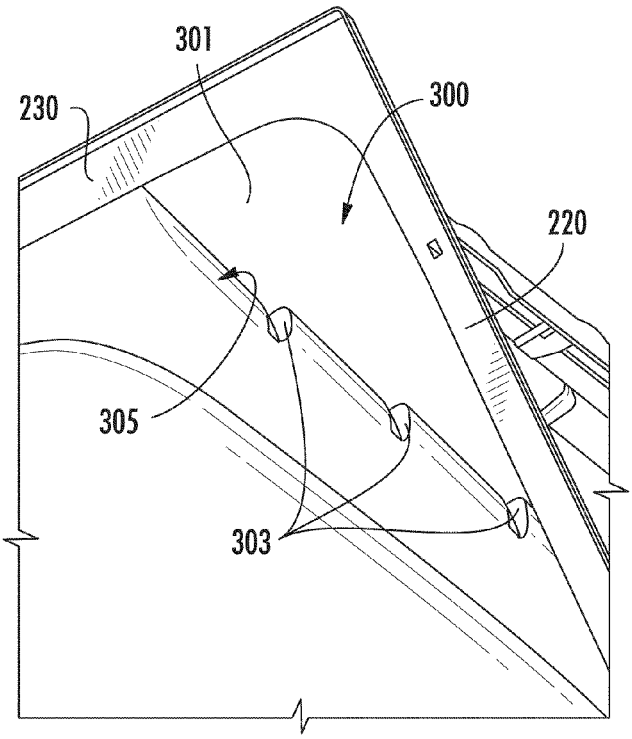
FIG. 4C is another partial perspective view of the adaptable storage system of FIG. 4A.
Figure 4D:
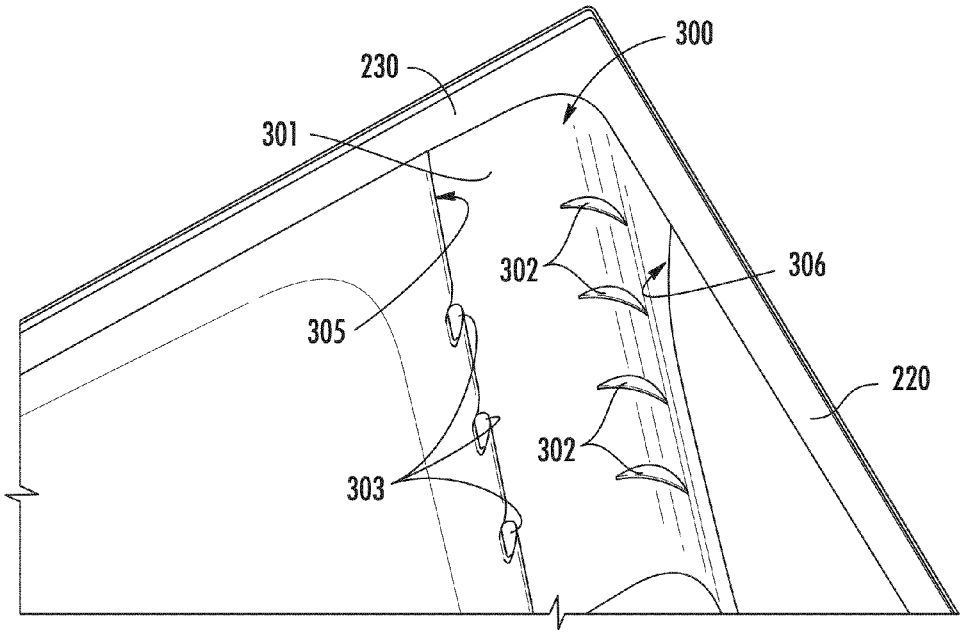
FIG. 4D is another partial perspective view of the adaptable storage system of FIG. 4A.
Figure 4E:
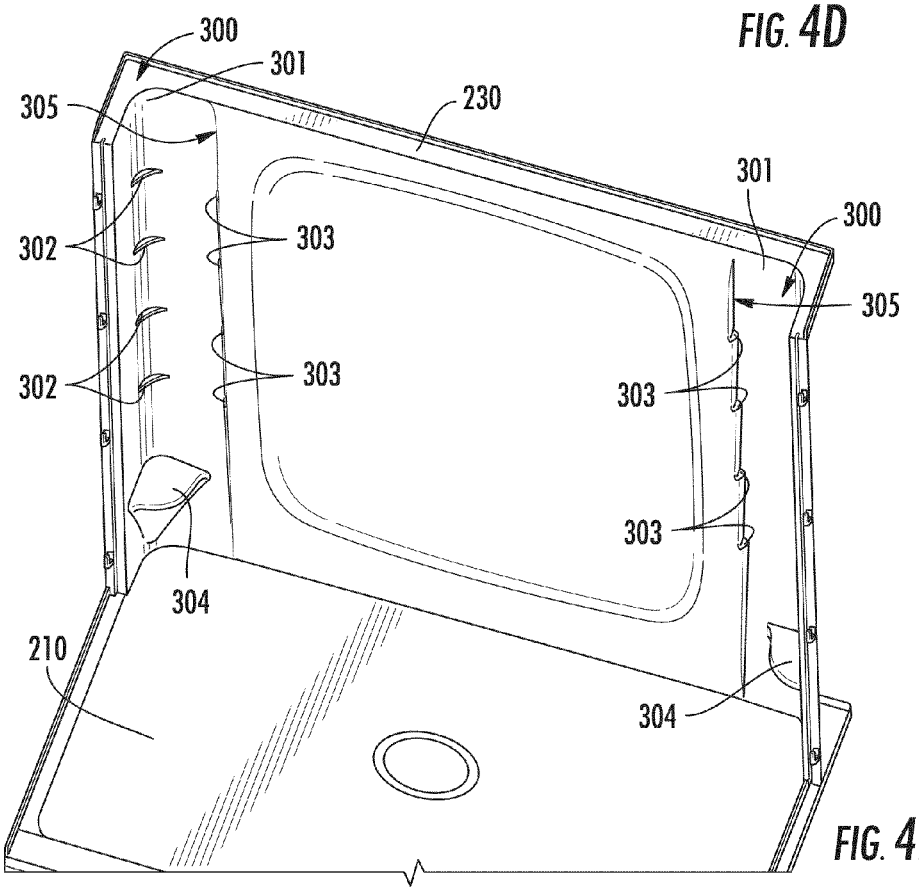
FIG. 4E is a perspective view of a back wall member of the adaptable storage system of FIG. 4A.
Figure 4F:
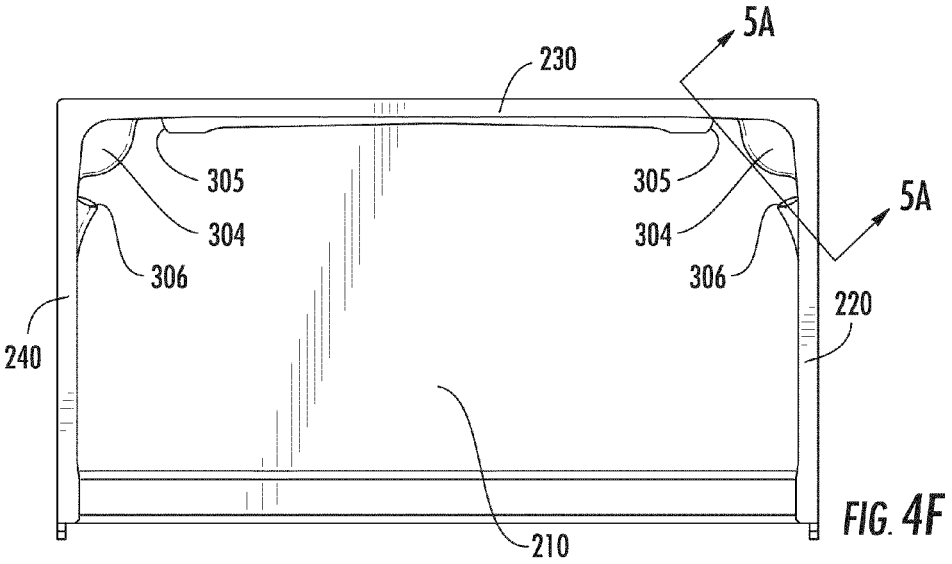
FIG. 4F is a top view of the adaptable storage system of FIG. 4A.

Referring now to FIGS. 3-4F, a shower enclosure 200 including a pair of storage systems 300 is shown according to an exemplary embodiment. In this embodiment, a pair of storage systems 300 are integrated into one or more of the wall panels of the shower enclosure 200 at the rear corners of the enclosure. As shown in FIGS. 3-4A, the shower enclosure 200 includes a back wall panel 230 (e.g., a first wall panel, a first wall member, etc.), a right end wall panel 220 (e.g., a right side wall panel, a first side wall member, a second wall member, etc.), a left end wall panel 240 (e.g., a left side wall panel, a second side wall member, a third wall member, etc.), and a bottom panel 210 (e.g., a receptor, etc.). The back wall panel 230 and the right and left end wall panels 220 and 240 cooperatively define the pair of storage systems 300. That is to say, each of the back wall panel 230 and the right and left end wall panels 220 and 240 include a portion of the storage system 300 integrated therein (e.g., molded therein, etc.).

As shown in FIGS. 4A-4F, each storage system 300 includes a recessed (e.g., niche, alcove, etc.) area extending in a longitudinal direction along each of the rear corners of the enclosure 200 where the right and left end wall panels 220 and 240 join with the back wall panel 230. The storage system 300 is defined by a plurality of notches (e.g., cutouts, channels, ledges, etc.) at least partially extending along a horizontal direction into the recessed area of each of the back wall panel 230 and the right and left end wall panels 220 and 240. Each of the notches defines a support surface configured to receive a portion of an accessory thereon, such as a shelf, a receptacle 310, a support ledge, a storage rack, a grab bar, a support frame, or other types of accessories, the details of which are discussed below.

Referring to FIGS. 4A-4F, the shower enclosure 200 including the storage systems 300 is shown. As shown, the back wall panel 230, the right end wall panel 220, and the left end wall panel 240 cooperatively define each storage system 300. Each of the back wall panel 230 and end wall panels 220 and 240 can include a portion of the storage system 300, such that when the right and left end wall panels 220 and 240 are coupled to the back wall panel 230 they form two complete storage systems 300 at the rear corners of the enclosure. For example, at least a portion of the storage system 300 can be integrated into (i.e., integrally formed with) one or more of the wall panels when the wall panels are manufactured (e.g., molded, formed, etc.). According to an exemplary embodiment, the wall panels are made (e.g., molded, formed, etc.) from a sheet molded compound (SMC) commercially available under the trade name Vikrell. According to other exemplary embodiments, the wall panels are made from another rigid or semi-rigid material or combinations of materials suitable for use in a shower or bathing environment.

As shown in FIGS. 4A-4E, the storage system 300 is a generally recessed area or portion extending along the entire length of each corner of the enclosure, adjacent the back wall panel 230 and the right and left end wall panels 220 and 240. According to the exemplary embodiment shown, the back wall panel 230 includes a pair of integrated corner sections defining a recessed portion at each corner. That is, the back wall panel 230 includes a generally planar back wall and a pair of end walls oriented perpendicular to the generally planar back wall and extending outwardly therefrom at the ends of the back wall to define the rear corners of the enclosure. The recessed portion of the storage system 300 is defined by inner surface 301 (e.g., arcuate surface, tapered surface, etc.) that includes a plurality of corner notches 302 (e.g., channels, steps, ledges, levels, etc.) disposed therein and extending along a longitudinal direction within the recessed portion. Each of the corner notches 302 includes a generally horizontal surface for receiving and supporting a portion of an accessory thereon.

According to the exemplary embodiment shown in FIGS. 4B-4F, one or more side notches 303 are disposed along an inner side surface 305 of the back wall panel 230 (e.g., first side notches), adjacent the recessed portion. The inner side surface 305 extends in a longitudinal direction along the back wall panel 230 and protrudes outwardly toward the interior of the shower enclosure at each end of the back wall panel 230. Similarly, as shown in FIG. 4D, one or more side notches 303 (e.g., second side notches) are also disposed along an inner side surface 306 of the right and left end wall panels 220 and 240 near an end of each respective panel, adjacent the recessed portions of the back wall panel 230. Each of the side notches 303 includes a generally horizontal surface for receiving and supporting a portion of an accessory thereon.

According to the exemplary embodiment shown in FIGS. 4E-4F, each corner or recessed portion of the back wall panel 230 includes a protrusion 304 extending outwardly away from the corner toward an interior of the enclosure. The protrusion 304 includes a contoured surface (e.g., curved, arcuate, etc.) that acts a foot support for a user of the shower enclosure. The protrusion 304 is located at a height above the receptor 210 sufficient to allow a user to place their foot on the support during, for example, shaving or bathing.

According to an exemplary embodiment, each of the corner notches 302 and the side notches 303 are spaced apart from each other and arranged in a vertically stacked configuration to define a plurality of levels or zones within the recessed portion. At each level or zone a side notch 303 of the back wall panel 230, a side notch 303 of the right/left end wall panel 220/240, and a corner notch 302 of the back wall panel 230 defines an installation area or zone for receiving a storage accessory therein, such as a shelf, a receptacle, a support ledge, or another type of accessory for use in the shower enclosure 200.

For example, at each level or installation zone, there are two side notches 303 spaced opposite each other and one corner notch 302 arranged along the recessed portion of the storage system 300. At each level, the two side notches 303 and the corner notch 302 are located within the recessed portion such that the horizontal surfaces of the notches 302 and 303 are coplanar with each other to collectively define a coplanar support surface for supporting an accessory thereon (e.g., receptacle 310, etc.). As shown, the two side notches 303 and the corner notch 302 at each level are spaced apart from each other in a triangular arrangement within the recessed portion. Each of the corner notches 302 and the side notches 303 extend at least partially along the inner surface 301 of the recessed portion. According to other exemplary embodiments, at each level or installation zone, the corner notch 302 and the side notches 303 are connected to each other to define a single continuous support surface extending along at least a portion of the inner surface 301.

Figure 5A:
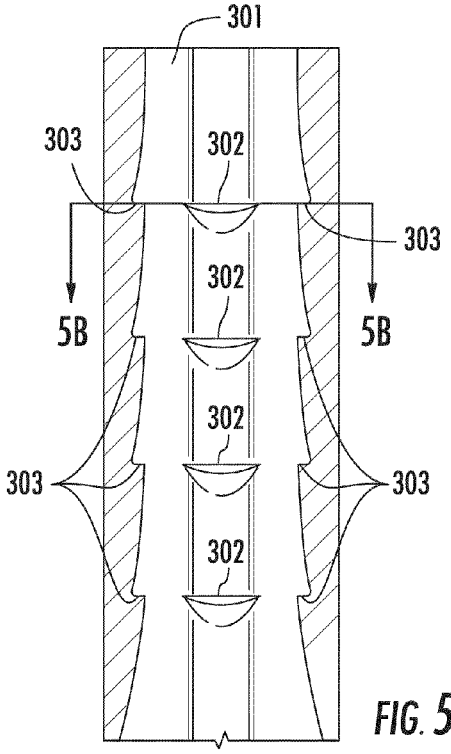
FIG. 5A is a partial cross-sectional view taken along line 5A-5A in FIG. 4F.

FIG. 5A is a cross-sectional view of the storage system 300 taken along line 5A-5A in FIG. 4F. As shown in FIG. 5A, the recessed portion of the storage system 300 includes an inner surface 301 that tapers or curves inwardly at various heights and locations within the recessed portion to define each of the corner notches 302 and the side notches 303 of the back wall panel 230. Furthermore, the tapered or curved shape of the inner surface 301 can facilitate installation of an accessory within the recessed portion. For example, an accessory 310 shown as a receptacle in FIGS. 6 and 8A-9, can be inserted into the recessed portion of the storage system 300, and then rotated in a direction indicated generally by the arrows in FIG. 8A to an installed position along a corner notch 302 and a pair of side notches 303 along an installation zone (see, for example, FIGS. 7-8B). According to an exemplary embodiment, the accessory 310 includes one or more flexible tabs 312 (see, for example, FIG. 9) that can be received within one or more of the side notches 303, respectively. The accessory 310 can further include a rim 311 (see, for example, FIG. 9) at the corner of the accessory 310 that can engage the corner notch 302 to support the accessory in a vertical direction within the storage system. Each of the side notches 303 can also provide vertical support for the accessory 310. According to an exemplary embodiment, the accessory 310 is constrained in a vertical direction by virtue of an interference condition between the flexible tabs 312 of the accessory and the pair of side notches 303.

Figure 5B:
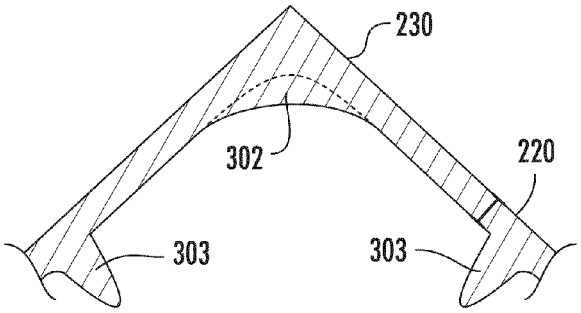
FIG. 5B is a partial cross-sectional view taken along line 5B-5B in FIG. 5A.
Figure 6:
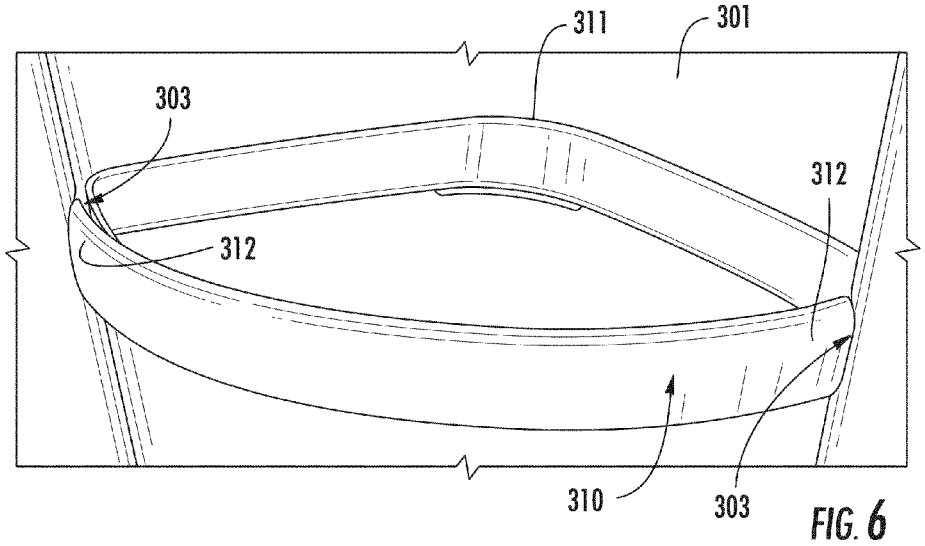
FIG. 6 is a partial perspective view of the adaptable storage system of FIG. 4A including a receptacle, according to an exemplary embodiment.

FIG. 5B is a cross-sectional view of the storage system 300 taken along line 5B-5B in FIG. 5A. As shown in FIG. 5B, the corner notch 302 and the side notches 303 along an installation zone extend partially along the recessed portion of the storage system 300. The corner notch 302 and the two side notches 303 include generally planar surfaces that are coplanar with each other to cooperatively define a coplanar support surface or installation zone for installation of an accessory thereon. As noted above, at each level or zone, a corner notch 302 and a pair of side notches 303 are arranged in a triangular configuration to define a support surface sufficient to hold an accessory thereon.

Figure 7:
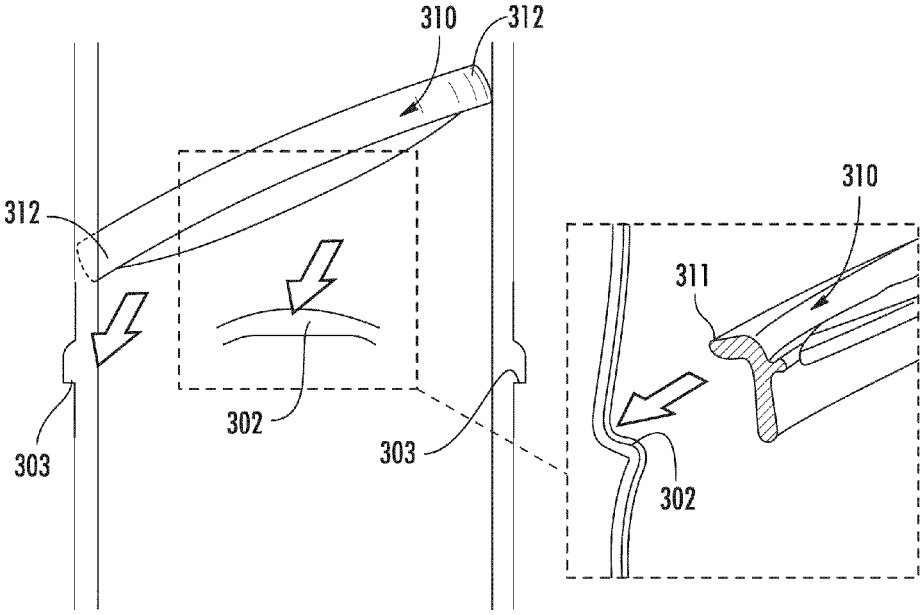
FIG. 7 is a schematic illustration of an assembly sequence for installing an accessory into the adaptable storage system of FIG. 4A.
Figure 8A:
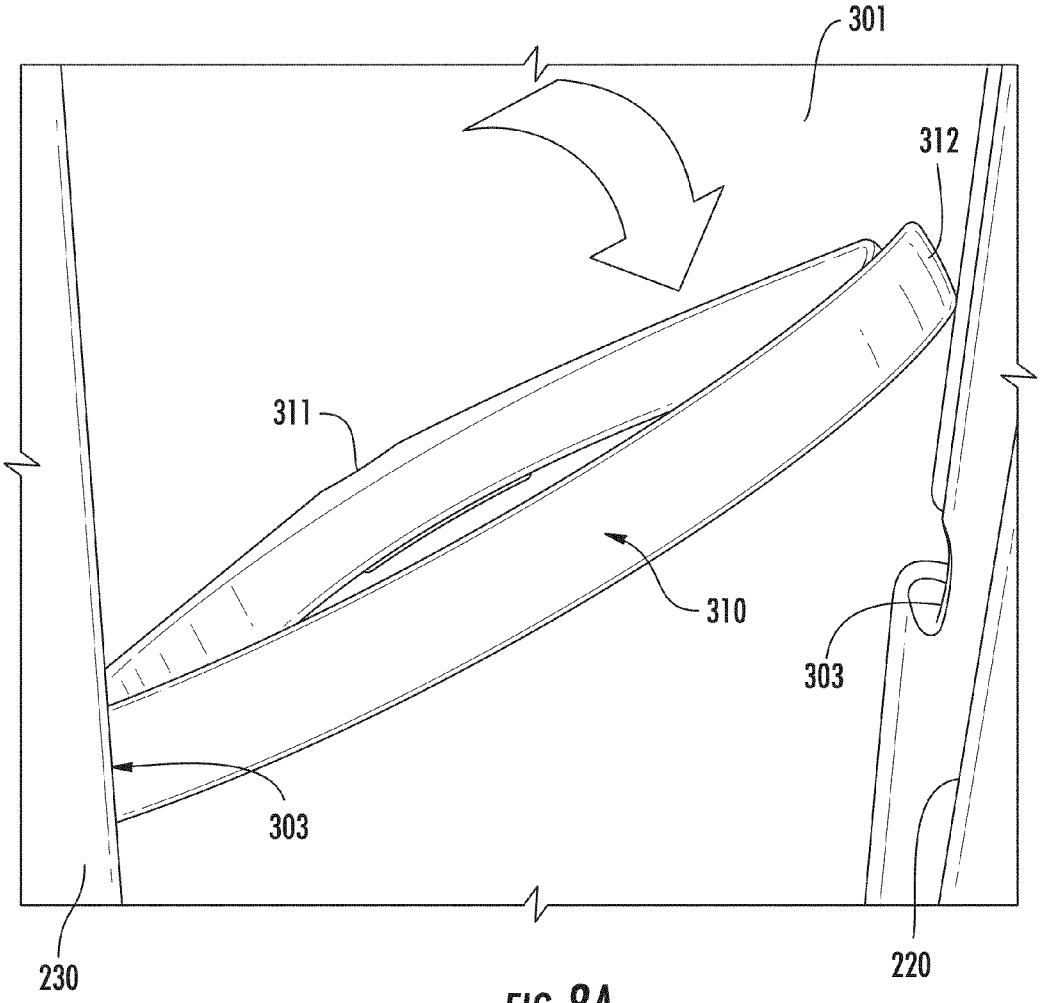
FIG. 8A is a perspective view of an accessory being installed into the adaptable storage system of FIG. 4A.
Figure 8B:
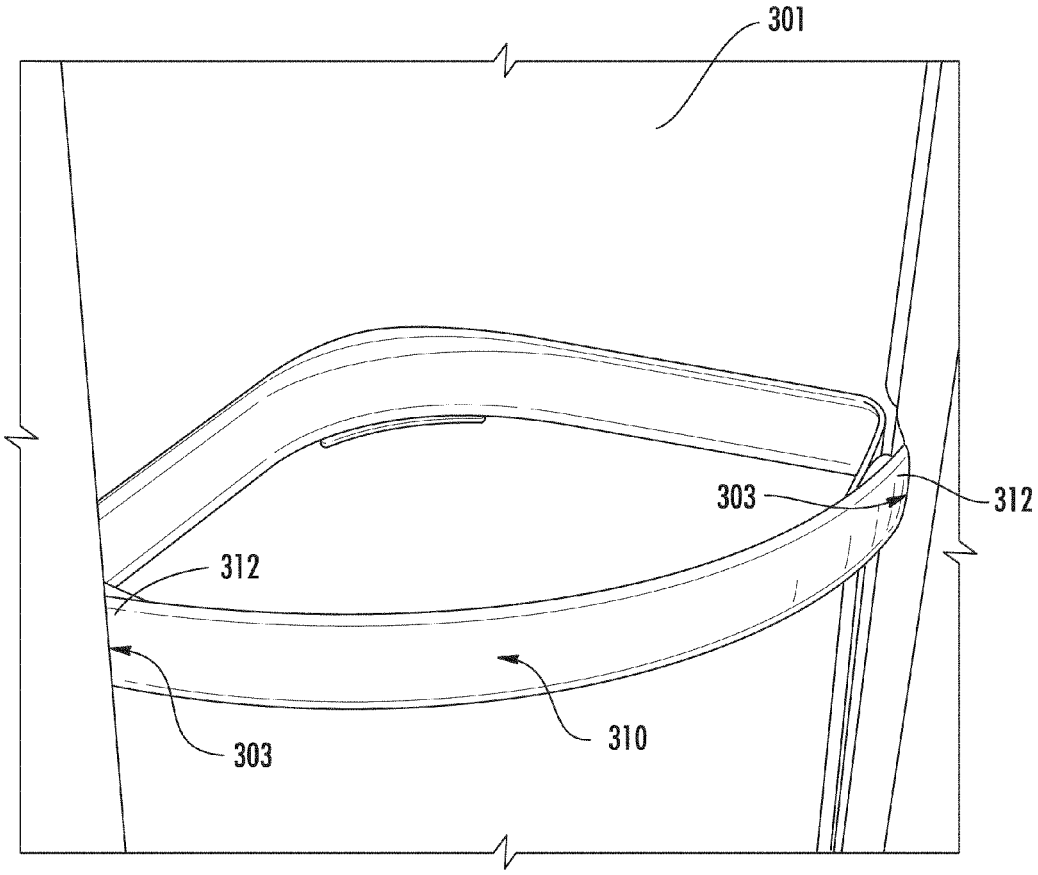
FIG. 8B is a perspective view of the accessory of FIG. 8A shown in an installed state within the adaptable storage system.

For example, referring now to FIGS. 6-8B, an accessory 310 is shown being installed (e.g., removably coupled) in a storage system 300 according to an exemplary embodiment. A corner notch 302 and side notches 303 along an installation zone within the recessed portion can cooperate to couple the accessory 310 within the storage system 300. It is appreciated that various types of accessories can be coupled within the storage system 300, such as a receptacle, a support ledge, a storage cabinet, a grab bar, a support frame, or the like, according to other exemplary embodiments. As shown in FIGS. 7-8A, the accessory 310 can be rotated to a horizontal, installed position within the storage system 300 by engaging a portion of the accessory with the side notches 303 and the corner notch 302, such that the accessory is substantially supported by the coplanar support surface defined by the pair of side notches 303 and the corner notch 302 along an installation zone.

For example, as shown in FIGS. 7-8A, a user can insert the accessory 310 into the recessed portion of the storage system 300, such that the flexible tabs 312 are located nearest the side notches 303, and the corner rim 311 of the receptacle is located nearest the corner notch 302 of the installation zone. To insert the accessory into the recessed portion, the user can rotate or tilt the accessory 310 in the manner shown in FIG. 8A. Once inserted, the user can insert the left side tab 312 into a side notch 303 of the back wall panel 230. The user can then rotate the accessory 310 in the direction indicated generally by the arrow in FIG. 8A until the right side tab 312 engages with the side notch 303 of the right end wall panel 220. The right side tab 312 will deflect or flex inwardly toward an interior of the receptacle 310 until the tab is received within the notch 303 of the right end wall panel 220. As shown in FIG. 7, when the receptacle 310 is being rotated into the installed position, the rim 311 is engaged with the corner notch 302, such that the rear portion of the receptacle 310 is substantially supported in a vertical direction by the corner notch 302.

If a user wishes to remove the receptacle 310 from the installed position within the storage system 300, the user can simply apply an upward force at either or both corners of the accessory below the tabs 312 to deflect or flex the tabs inwardly toward the interior of the receptacle away from the side notches 303. In this way, the tabs 312 can be selectively disengaged from the side notches 303, and the receptacle 310 can be lifted out of the installed position and relocated to a different position within the storage system 300, or completely removed from the storage system. Although the installation and removal sequence is discussed with respect to the storage system 300 formed between the right side panel 220 and the back wall panel 230, it is appreciated that the same installation sequence or process can be applied to the storage system 300 formed between the left side panel 240 and the back wall panel 230 at an opposite corner of the enclosure.

According to an exemplary embodiment, there is an interference condition between at least a portion of the accessory 310 and the side notches 303, such that the accessory 310 is constrained in a vertical direction within the storage system 300. For example, the tabs 312 of the accessory 310 can engage one or more of the surfaces defined by the side notches 303, such that the tabs 312 are retained within the side notches 303. The storage accessory 310 can be selectively removed from its location within the storage system 300 by a user or an installer applying an upward force to a bottom portion of the accessory at either or both corners of the accessory below the tabs 312 to disengage the tabs from the side notches 303. The user may also apply an upward force to a bottom portion of the accessory 310 below the rim 311 to disengage the accessory from the corner notch 302, and then rotate the accessory out of engagement with the side notches 303. In this way, the accessory 310 can be selectively coupled to and removed from the storage system 300 by a user or an installer as desired.

Figure 9:
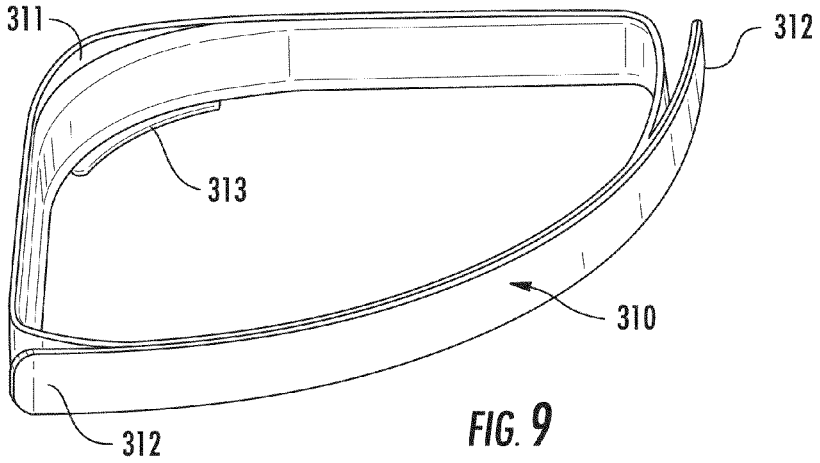
FIGS. 9-24 illustrate various types of accessories for use in the storage system of FIG. 4A, according to various exemplary embodiments.

Referring to FIG. 9, an accessory shown as a receptacle 310 (e.g., a shelf, a holder, a container, etc.) for use in the storage system 300 is shown according to an exemplary embodiment. The receptacle 310 can be removably coupled along the recessed portion of the storage system 300 by selectively engaging the accessory with a coplanar support surface defined by a corner notch 302 and a pair of side notches 303 along an installation zone within the recessed portion. As shown in FIG. 9, the receptacle 310 includes a pair of tabs 312 having an arcuate shape and extending outwardly along a front portion of the accessory. The tabs 312 extend continuously with the front surface of the accessory and outwardly at each end thereof. Each of the tabs 312 further includes a top edge and a bottom edge configured to engage a side notch 303 of the storage system 300. The tabs 312 can flex or deflect (e.g., elastically deform, etc.) toward or away from an interior of the receptacle 310 when a force is applied to them, to thereby facilitate installation/removal of the receptacle within the storage system 300. That is to say, the tabs 312 can be received within a pair of side notches 303, respectively, to removably couple the receptacle 310 to the storage system 300. For example, referring again to FIGS. 8A-8B, the front surface of each tab 312 can engage an inner surface of a side notch 303. In addition, the top edge of each tab 312 can engage an upper surface of a side notch 303, and the bottom edge can engage a lower surface of a side notch 303. In this way, the receptacle 310 is substantially constrained in a vertical direction by the side notches 303.

Referring again to FIG. 9, the receptacle 310 further includes a rim 311 (e.g., a flange, etc.) extending outwardly along an upper portion of the receptacle at an outer periphery thereof. The rim 311 can engage a corner notch 302 of the storage system 300 at a bottom surface thereof to provide vertical support to the receptacle 310. The rim 311 is configured to rest or sit on an upper surface of the corner notch 302 to provide support thereto. The receptacle 310 further includes one or more openings 313 to allow for fluids to vacate the interior of the receptacle 310, and to prevent the accumulation of dirt and bacteria therein.

Figure 10:
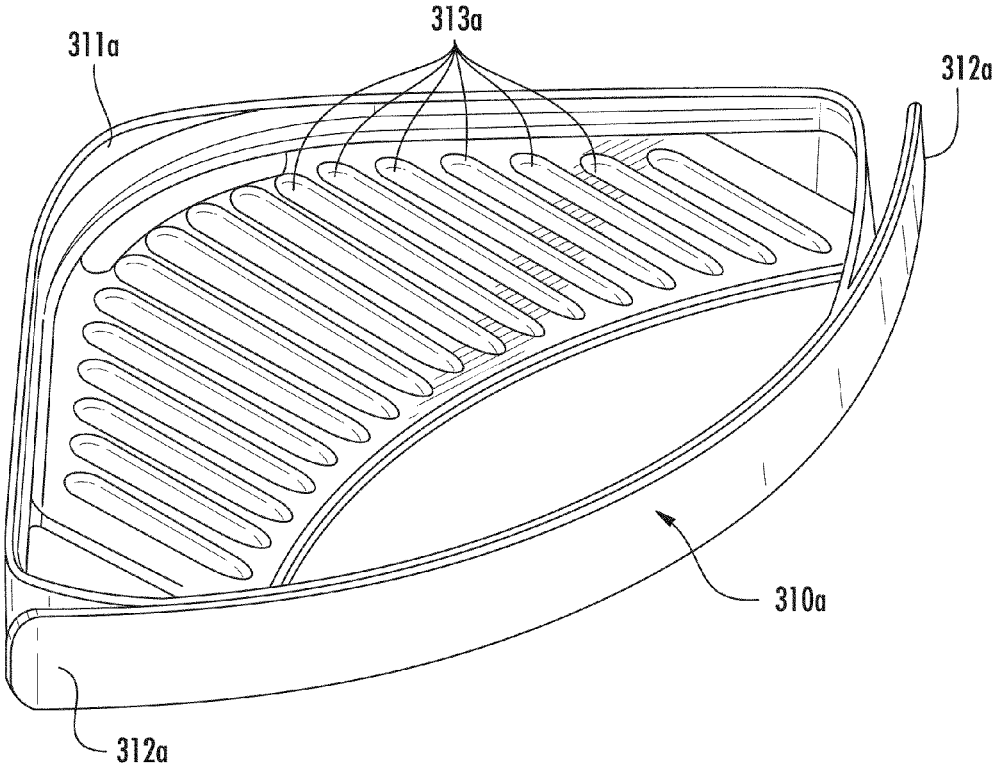

Referring to FIG. 10, an accessory shown as a tray 310*a* for use in the storage system 300 is shown according to an exemplary embodiment. The tray 310*a* can be removably coupled along the recessed portion of the storage system 300 in the same way as discussed above with respect to the receptacle 310. As shown in FIG. 10, the tray 310*a* includes a pair of arcuate tabs 312*a* extending outwardly along a front portion of the accessory. The tabs 312*a* extend continuously with the front surface of the accessory and outwardly at each end thereof. The tabs 312*a* can flex or deflect (e.g., elastically deform, etc.) when a force is applied to them, to thereby facilitate installation of the tray within the storage system 300. The tray 310*a* further includes a rim 311*a* extending outwardly along an upper portion of the tray at an outer periphery thereof. The rim 311*a* can engage a corner notch 302 of the storage system 300 at a bottom surface thereof to provide vertical support to the tray 310*a*. The rim 311*a* is configured to rest or sit on an upper surface of the corner notch 302 to provide support thereto. The tray 310*a* further includes one or more openings 313*a* to allow for fluids to vacate the interior of the tray, and to prevent the accumulation of dirt and bacteria therein.

Figure 11:
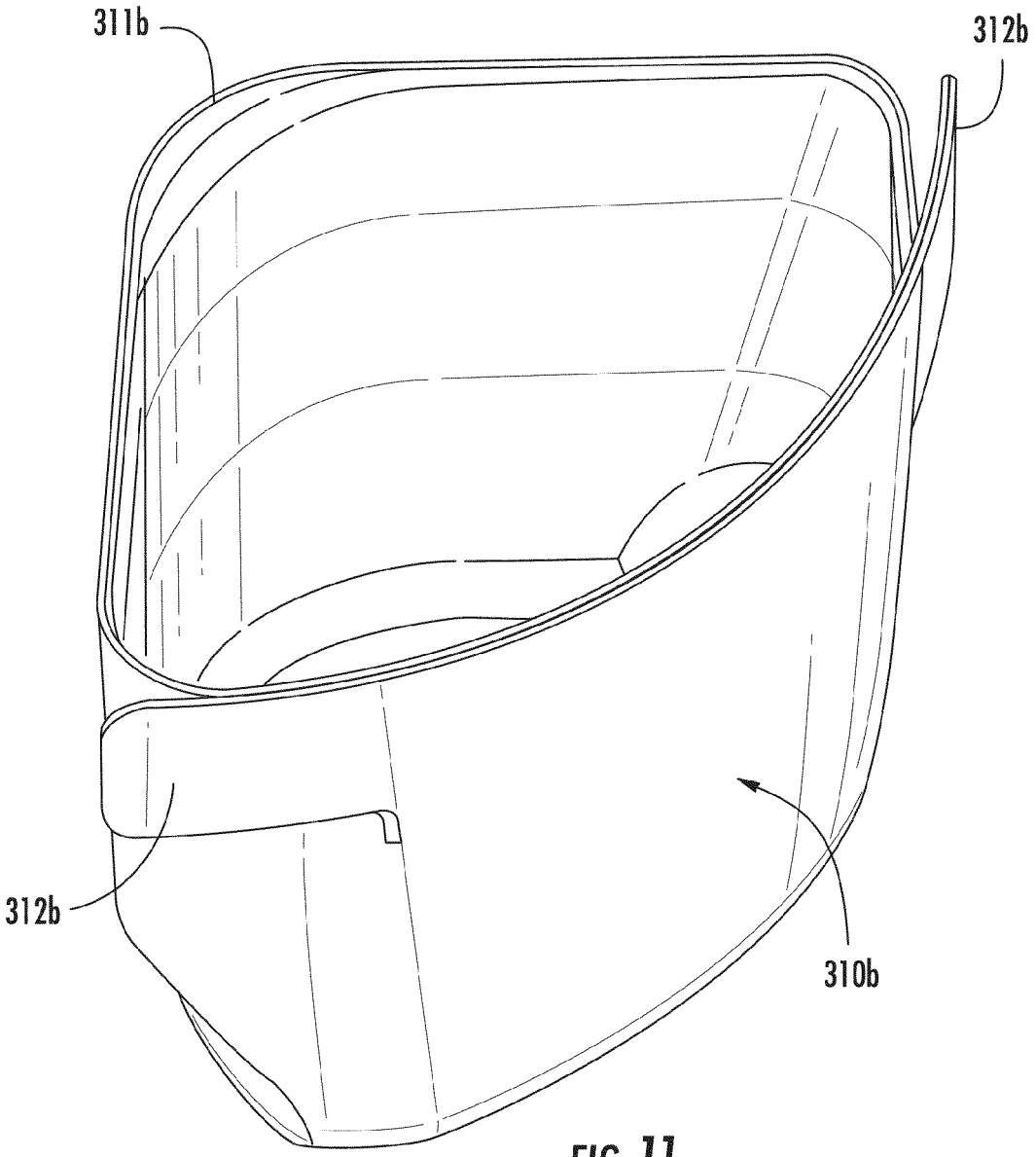

Referring to FIG. 11, an accessory shown as a bin 310*b* for use in the storage system 300 is shown according to an exemplary embodiment. The bin 310*b* can be removably coupled along the recessed portion of the storage system 300 in the same way as discussed above with respect to the receptacle 310. As shown in FIG. 11, the bin 310*b* includes a pair of arcuate tabs 312*b* extending outwardly along a front portion of the accessory. The tabs 312*b* extend continuously with a portion of the front surface of the accessory and outwardly at each end thereof. The tabs 312*b* can flex or deflect (e.g., elastically deform, etc.) when a force is applied to them, to thereby facilitate installation of the bin within the storage system 300. The bin 310*b* further includes a rim 311*b* extending outwardly along an upper portion of the bin at an outer periphery thereof. The rim 311*b* can engage a corner notch 302 of the storage system 300 at a bottom surface thereof to provide vertical support to the bin 310*b*. The rim 311*b* is configured to rest or sit on an upper surface of the corner notch 302 to provide support thereto.

Figure 12A:
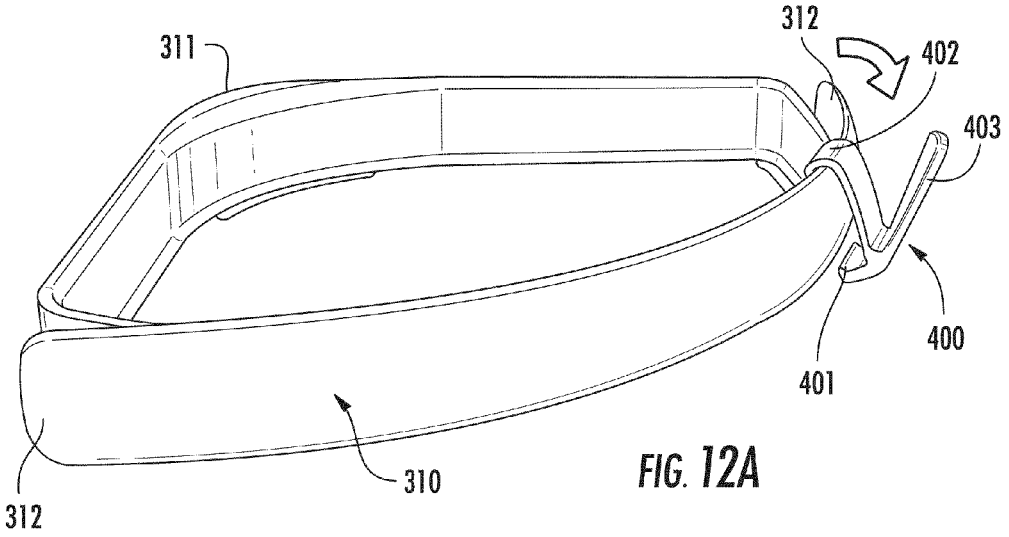
Figure 12B:
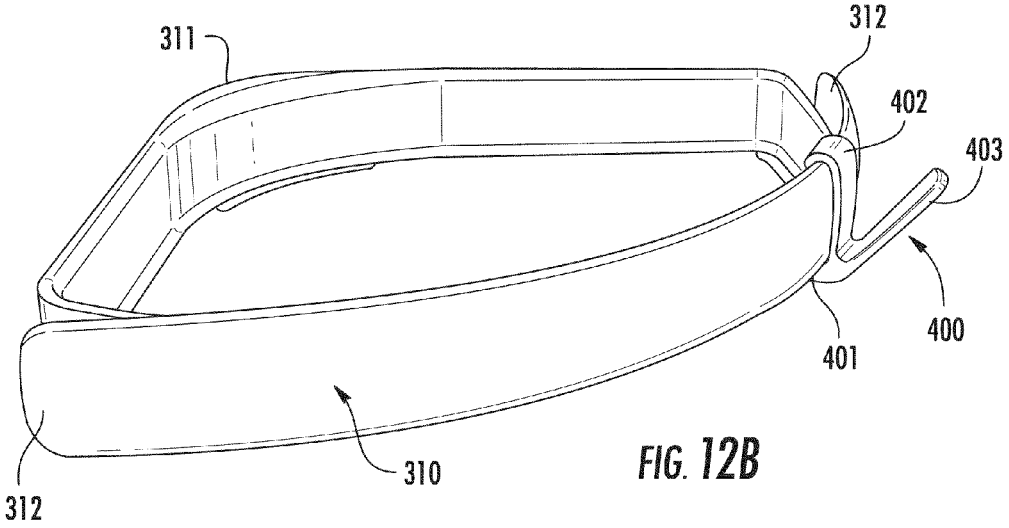

Referring to FIGS. 12A-12B, the receptacle 310 of FIG. 9 is shown including a hook 400 removably coupled to a front portion of the receptacle. The hook 400 can allow a user to hang various bathing items along an outer area of the receptacle, such as a loofah, a washcloth, a scrub brush, or any other bathing item that can be hung within a bathing environment. The hook 400 includes a lower protrusion 401, an upper latch 402, and an extension 403. The protrusion 401 is located opposite the upper latch 402, and the extension 403 extends from the protrusion 401 outwardly away from the upper latch 402 at an angle of less than 90 degrees. The upper latch 402 can engage (e.g., hang on, hook on, etc.) an upper edge of an accessory, such as the receptacle 310. The hook 400 can be rotated such that the protrusion 401 can engage a lower edge of the accessory, to thereby couple the hook 400 to the accessory.

For example, FIG. 12A illustrates the hook 400 being hung onto the front wall of the receptacle 310. A user or an installer can hang the hook 400 on a top edge of the front wall of the bin 310 via the upper latch 402. The user or installer can then rotate the hook 400 in the direction indicated by the arrow in FIG. 12A, such that the hook snaps into place on a lower edge of the receptacle via the protrusion 401. That is, the protrusion 401 can create an interference condition with the lower edge of the receptacle 310 such that the hook 400 is locked into place relative to the receptacle. The extension 403 can, advantageously, extend outwardly away from the receptacle 310 to allow a user to hang various bathing items onto the hook 400.

Referring now to FIGS. 13-32, various accessories for use in the storage system 300 are shown according to various exemplary embodiments. The storage system 300 is configured to receive a variety of different accessories including accessories having different aesthetics, configurations, functions, and sizes. In the various exemplary embodiments of the accessories disclosed herein, the assembly and removal sequence as described above with respect to the receptacle 310 along a corner notch 302 and side notches 303 of the storage system 300 is substantially the same.

Figure 13:
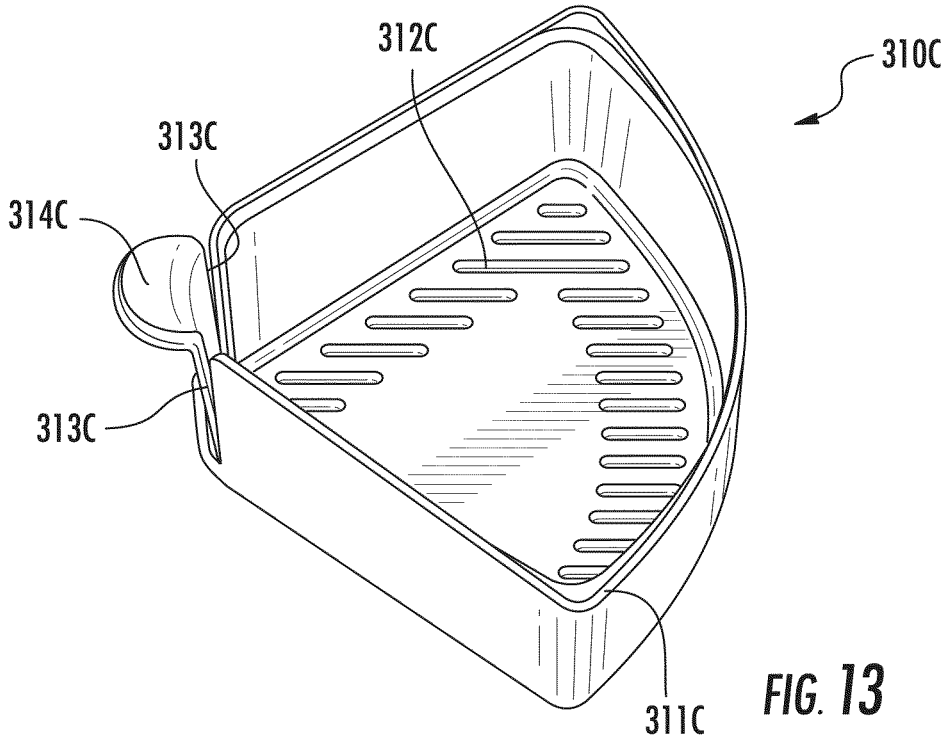
Figure 14:
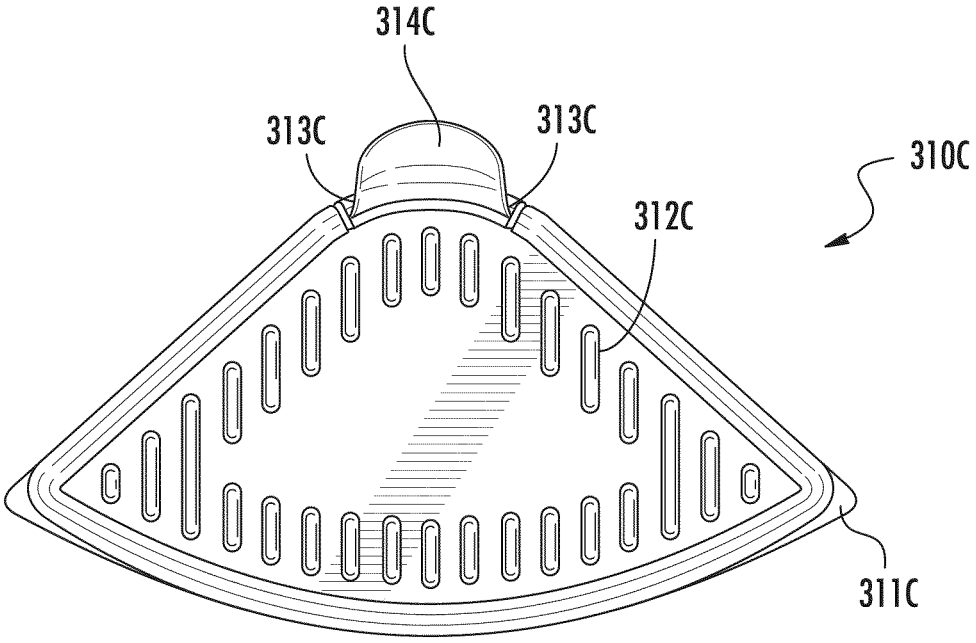

Referring now to FIGS. 13-14, an accessory shown as a receptacle 310*c* for use in the storage system 300 is shown, according to an exemplary embodiment. The receptacle 310*c* is configured to be removably coupled within the storage system 300. The receptacle 310*c* includes a rim 311*c* extending along an upper portion of an outer periphery of the receptacle 310. The rim 311*c* is configured to engage a corner notch 302 and side notches 303 of the storage system 300, such that the rim 311*c* substantially supports the receptacle 310*c* when the receptacle 310*c* is coupled to the storage system 300. The receptacle 310*c* includes one or more openings 312*c* to allow for fluid (e.g., water, etc.) or other liquids (e.g., liquid soap, shampoo, etc.) to vacate an interior portion of the receptacle 310*c*.

Still referring to FIGS. 13-14, the receptacle 310*c* includes a pair of cutouts 313*c* defining a tab 314*c* configured to flex or deflect when the receptacle 310*c* is coupled to or removed from the storage system 300. The tab 314*c* includes a portion of the rim 311*c*, such that when the tab 314*c* is flexed or deflected, the footprint of the rim 311*c* changes to allow for installation or removal of the bin to or from the corner notch 302 and side notches 303 of the storage system. For example, when the receptacle 310*c* is being installed into the storage system 300, the rim 311*c* engages a corner notch 302 and side notches 303 and the tab 314*c* flexes inward toward the inside of the bin, because of an interference condition created between the receptacle 310*c* and the recessed portion of storage system 300. The receptacle 310*c* is substantially supported by the corner notch 302 and side notches 303 and is retained in a vertical direction by virtue of the interference condition between the receptacle 310*c* (e.g., the tab 314, etc.) and the side notches 303 of the storage system 300. Similarly, to remove the receptacle 310*c* from the storage system 300, a user can pull the tab 314*c* further inward toward the inside of the bin and/or can apply an upward force to a bottom surface of the receptacle 310*c* to disengage the rim 311*c* from the corner notch 302 and side notches 303. In this way, a user or an installer can easily install, remove, or adjust a position of the receptacle 310*c* within the storage system 300 as desired.

Figure 15:
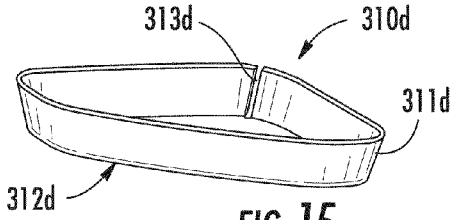

According to an exemplary embodiment shown in FIG. 15, an accessory shown as a receptacle 310*d* includes a rim 311*d* extending along a periphery of the receptacle 310*d*. The rim 311*d* is configured to engage a corner notch 302 and side notches 303 of the storage system 300 such that the receptacle 310*d* is substantially supported by the rim 311*d*. The receptacle 310*d* includes a slot or cutout 313*d* to allow the side walls of the receptacle 310*d* to flex when the receptacle 310*d* is removably coupled to or removed from the storage system 300. The receptacle 310*d* also includes an opening 312*d* configured to allow fluids (e.g., water, liquid soap, shampoo, lotion, etc.) to vacate the storage area of the bin 310*d*.

Figure 16:
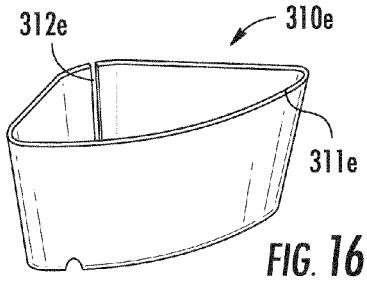

According to another exemplary embodiment shown in FIG. 16, an accessory is shown as a receptacle 310*e*. In this embodiment, the receptacle 310*e* includes a storage area having a larger capacity than the storage area of the receptacle 310*e* of FIG. 15. The receptacle 310*e* includes a rim 311*e* extending along an upper portion of the bin along an outer side periphery thereof. At least a portion or all of the rim 311*e* is configured to engage a corner notch 302 and side notches 303 of the storage system 300 such that the receptacle 310*e* is substantially supported by the rim 311*e*. The receptacle 310*e* includes a slot or a cutout 312*e* to allow one or more of the side walls of the receptacle 310*e* to flex when the bin is coupled to or removed from the storage system 300. In this way, the receptacle can be removably coupled along a corner notch 302 and side notches 303 by virtue of an interference condition between the receptacle and the surface 301 and/or the corner notch 302 and side notches 303.

Figure 17:
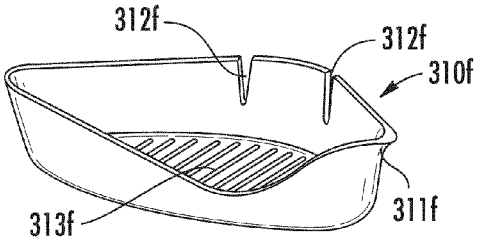

According to another exemplary embodiment shown in FIG. 17, an accessory is shown as a receptacle 310*f*. In this embodiment, the receptacle 310*f* includes a contoured (e.g., curved, arcuate, etc.) front wall sufficient to allow a user to access various items contained within a storage area of the accessory 310*f*. The receptacle 310*f* includes a rim 311*f* extending along an outer side periphery of the bin 310*f*. The rim 311*f* is configured to engage a corner notch 302 and side notches 303 of the storage system 300 such that the receptacle 310*f* is substantially supported by the rim 311*f*. The receptacle 310*f* includes a pair of slots or cutouts 312*f* to allow one or more of the side walls of the receptacle 310*f* to flex when the bin is coupled to or removed from the storage system 300. In this way, the receptacle can be removably coupled along a corner notch 302 and side notches 303 by virtue of an interference condition between the receptacle and the corner notch 302 and side notches 303. The receptacle 310*f* also includes one or more openings 313*f* configured to allow fluids (e.g., water, liquid soap, shampoo, etc.) to vacate the bin.

Figure 18:
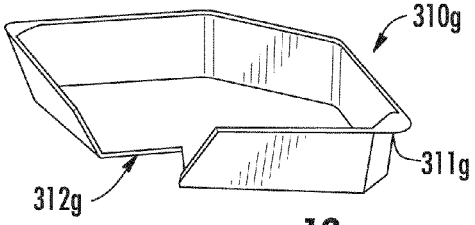

According to another exemplary embodiment shown in FIG. 18, an accessory is shown as a receptacle 310*g*. In this embodiment, the receptacle 310*g* has a different aesthetic design than the accessories of FIGS. 15-17. The receptacle 310*g* includes a notch 312*g* configured to receive or hold an item, such as a razor. The receptacle 310*g* includes a rim 311*g* extending along an outer side periphery of the bin 310*g*. The rim 311*g* is configured to engage a corner notch 302 and side notches 303 of the storage system 300 such that the receptacle 310*g* is substantially supported by the rim 311*g*. In this way, the receptacle can be removably coupled along a corner notch 302 and side notches 303 by virtue of an interference condition between the receptacle and the corner notch 302 and side notches 303.

Figure 19:
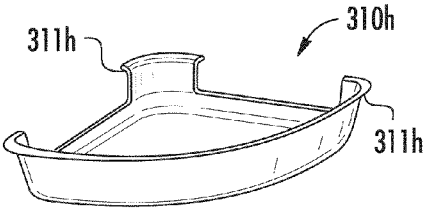

According to another exemplary embodiment shown in FIG. 19, an accessory is shown as a receptacle 310*h*. In this embodiment, the receptacle 310*h* includes cutout sections defining a front and a rear wall each configured to flex when the bin 310*h* is coupled to or removed from the storage system 300. In this way, the receptacle can be removably coupled along a corner notch 302 and side notches 303 by virtue of an interference condition between the receptacle and the arcuate surface 301 and/or the corner notch 302 and side notches 303. Each of the front and rear walls includes a rim 311*h* extending along an outer side periphery of the walls. The rim 311*h* is configured to engage a corner notch 302 and side notches 303 of the storage system 300 such that the storage tray 310*h* is substantially supported by the rim 311*h*.

Figure 20:
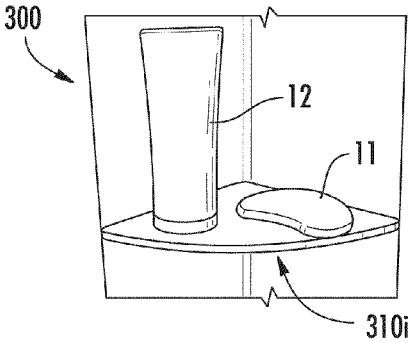

According to another exemplary embodiment shown in FIG. 20, an accessory is shown as a storage tray 310*i*. In this exemplary embodiment, the storage tray 310*i* is configured to hold and support one or more bathing items, such as a shampoo bottle 12 and a bar of soap 11, according to an exemplary embodiment. However, the storage tray 310*i* can hold a variety of different bathing items, according to other exemplary embodiments. As shown in FIG. 20, the storage tray 310*i* is configured to engage a corner notch 302 and side notches 303 of the storage system 300 along a peripheral edge of the tray 310*i*, such that the tray is substantially supported by the corner notch 302 and side notches 303.

Figure 21:
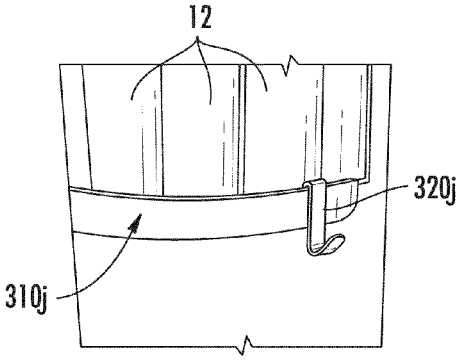

According to another exemplary embodiment shown in FIG. 21, an accessory is shown as a receptacle 310*j* removably engaged with a corner notch 302 and side notches 303 within the storage system 300. In this embodiment, the receptacle 310*j* includes a hook 320*j* configured to hold various bathing items, such as, for example, a washcloth, a scrubber, or another type of bathing item. According to an exemplary embodiment, the hook 320*j* is integrally formed with the receptacle 310*j*. According to other exemplary embodiments, the hook 320*j* is a separate component fixedly or removably coupled to the receptacle 310*j*. The receptacle 310*j* is configured to hold one or more bathing items, such as one or more shampoo bottles 12, although the receptacle 310*j* can hold a variety of other types of bathing items, according to other exemplary embodiments.

Figure 22:
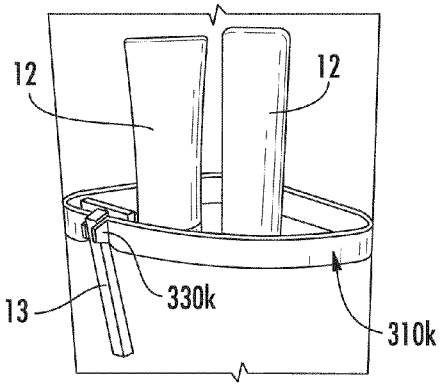

According to another exemplary embodiment shown in FIG. 22, an accessory is shown as a receptacle 310*k* removably engaged with a corner notch 302 and side notches 303 within the storage system 300. In this exemplary embodiment, the receptacle 310*k* includes a clip 330*k* configured to receive a bathing item, such as a razor, a toothbrush, or another similar type of bathing item. According to an exemplary embodiment, the clip 330*k* is integrally formed with the receptacle 310*k*. According to other exemplary embodiments, the clip 330*k* is a separate component fixedly or removably coupled to the receptacle 310*k*.

Figure 23:
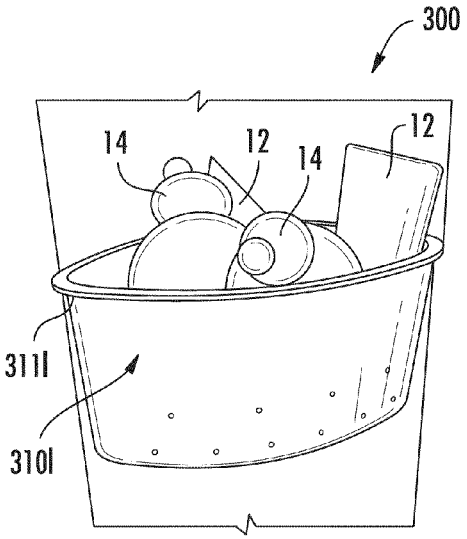

According to another exemplary embodiment shown in FIG. 23, an accessory is shown as a receptacle 310*l*. In this exemplary embodiment, the receptacle 310*l* has a large capacity storage area configured to receive and hold various bathing items therein, such as shampoo bottles 12 and toys 14. The receptacle 310*l* includes a plurality of openings located near a bottom portion of the receptacle 310*l* to allow fluids (e.g., water, shampoo, etc.) contained within the receptacle 310*l* to vacate/exit the bin. The receptacle 310*l* further includes a rim 311*l* extending along an outer side periphery of the receptacle. At least a portion of the rim 311*l* is configured to engage a corner notch 302 and side notches 303 of the storage system 300 such that the receptacle 310*l* is substantially supported by the rim 311*l* on the corner notch 302 and side notches 303 along an installation zone.

Figure 24:
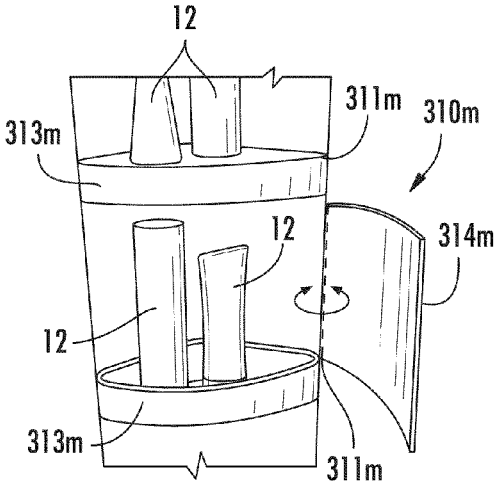

According to another exemplary embodiment shown in FIG. 24, an accessory is shown as a cabinet 310*m*. In this exemplary embodiment, the cabinet 310*m* includes trays 313*m* arranged in a stacked configuration with each tray engaged with a corner notch 302 and side notches 303 of the storage system 300. That is, each of the trays 313*m* includes a rim 311*m* that is engaged with a corresponding corner notch 302 and side notches 303 to substantially support the trays 313*m*. A door 314*m* is pivotably coupled between the trays 313*m* near a corner of each of the trays. According to an exemplary embodiment, the door 314*m* is removably coupled to the trays 313*m* such that a user or an installer can selectively remove the door to expose the contents stored within the cabinet area. The door 314*m* is configured to pivot (denoted by an arrow in FIG. 24) between an open position to allow a user to selectively access various items stored within the cabinet 310*m*, and a closed position to allow a user to selectively hide/conceal various bathing items from view and/or to protect the items from contamination (e.g., from getting wet, etc.). According to an exemplary embodiment, the upper tray 313*m* is configured to support one or more bathing items, such as, for example, shampoo bottles 12. Similarly, the lower tray 313*m* is configured to hold/retain one or more bathing items, such as shampoo bottles 12, although other types of bathing items may be stored on either of the trays 313*m*, according to other exemplary embodiments.

Figure 25:
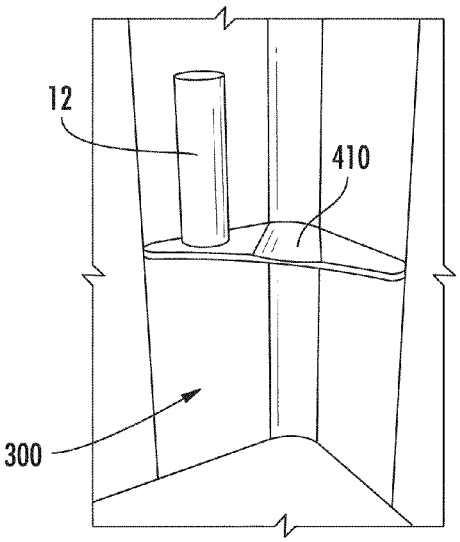
FIGS. 25-26 are perspective views of a support ledge for use in the storage system of FIG. 4A, according to an exemplary embodiment.
Figure 26:
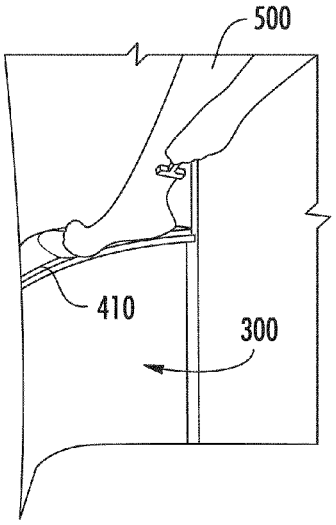

Referring now to FIGS. 25-26, an accessory is shown as a ledge 410, according to an exemplary embodiment. In this exemplary embodiment, the ledge 410 is removably coupled to a corner notch 302 and side notches 303 of the storage system 300 along an installation zone. The ledge 410 can include a peripheral edge configured to engage a corner notch 302 and side notches 303 of the storage system 300 such that the ledge 410 is substantially supported by the corner notch 302 and side notches 303. According to an exemplary embodiment shown in FIG. 26, the ledge 410 is configured to support the weight of at least a portion of a user 500, such as when the user 500 places or rests their foot on the support 410 when, for example, shaving or bathing. The ledge 410 can be selectively positioned within the storage system 300 along one of the notches 302 at a suitable height for a user 500 to access when showering. The ledge 410 is further configured to provide a support surface for one more bathing items, such as a shampoo bottle 12, according to an exemplary embodiment. According to the exemplary embodiment shown, the ledge 410 can include a localized depression or arcuate surface that is complementary to the contour of a user's foot, such that the ledge 410 provides a comfortable support for the user when shaving or bathing.

Figure 27:
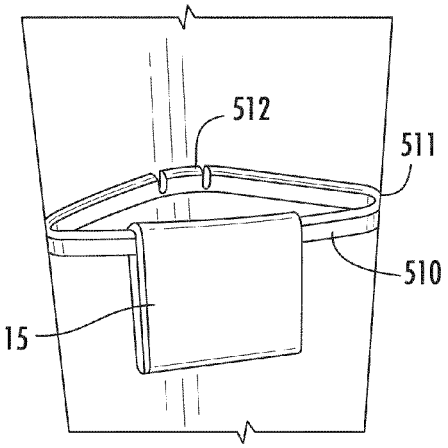
FIGS. 27-32 illustrate various accessory assemblies for use in the storage system of FIG. 4A, according to various exemplary embodiments.

Referring now to FIG. 27, an accessory is shown as a frame 510 for use in the storage system 300 according to an exemplary embodiment. In this embodiment, the frame 510 includes a rim 511 configured to engage a corner notch 302 and side notches 303 of the storage system 300 such that the corner notch 302 and side notches 303 substantially supports the frame 510. The frame 510 further includes a tab 512 configured to flex when the frame 510 is coupled to the corner notch 302 and side notches 303. That is, the frame 510 is constrained relative to the storage system 300 by an interference condition between the frame 510 (i.e., a portion of the tab 512 and the peripheral edge of the frame) and the surface adjacent a corner notch 302 and side notches 303. The frame 510 includes an opening defined by an inner surface configured to receive different types of accessories therein, such as shelves, bins, and the like. The frame 510 is further configured to act as a rack to hold various bathing items thereon, such as a towel 15, washcloths, or other similar types of bathing items when the frame 510 does not include an accessory installed therein.

Figure 28:
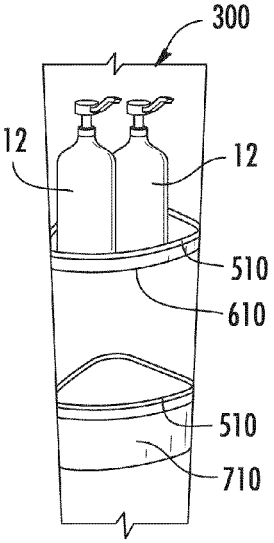

According to an exemplary embodiment shown in FIG. 28, a pair of frames 510 are each coupled to (e.g., engaged with) respective notches 302 and 303 of the storage system 300. The upper frame 510 includes an accessory shown as a recessed shelf 610 disposed therein. The lower frame 510 includes a different accessory shown as a shower bin 710 disposed therein. Each of the accessories 610 and 710 are configured to engage the inner surface of the frame 510 such that the frame 510 substantially supports the accessories 610 and 710, respectively. According to an exemplary embodiment, the inner surface of the frame 510 is configured to receive a variety of different accessories, each having a similar mounting interface. In this way, a user or an installer can swap or exchange different accessories in the frame 510 to create a custom storage configuration without having to remove the frame 510 from the storage system 300.

Still referring to FIG. 28, each of the accessories 610 and 710 is configured to hold/store one or more bathing items, such as shampoo bottles 12, although the accessories 610 and 710 can hold a variety of other types of bathing items, according to other exemplary embodiments (not shown). According to another exemplary embodiment, the accessory (e.g., recessed shelf 610, shower bin 710, etc.) is further configured to substantially hide or conceal the inner surface and the tab 512 of the frame 510, so as to improve the aesthetics of the storage system 300. An outer surface of the frame 510 can be exposed along a side periphery of the accessory to provide additional aesthetic improvements to the storage system 300. According to an exemplary embodiment, the frame 510 can include a surface treatment, such as paint, plating (e.g., chrome, nickel, etc.), or any other surface treatment suitable to provide an improved aesthetic.

Figure 29:
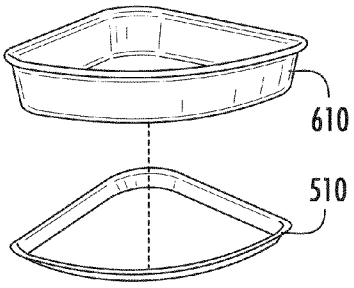
Figure 31:
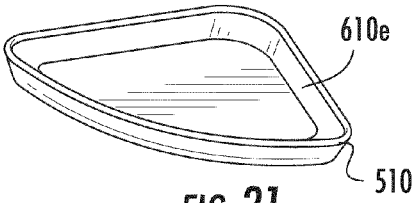

According to an exemplary embodiment shown in FIG. 29, an exploded view of the recessed shelf 610 and the frame 510 is shown. As explained above, the recessed shelf 610 is configured to be inserted into the opening of the frame 510, such that the inner surface of the frame 510 engages or contacts a corresponding rim/surface of the recessed shelf 610. In this way, the inner surface of the frame 510 is configured to substantially support the recessed shelf 610.

Figure 30:
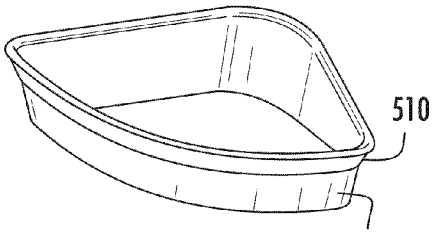
Figure 32:
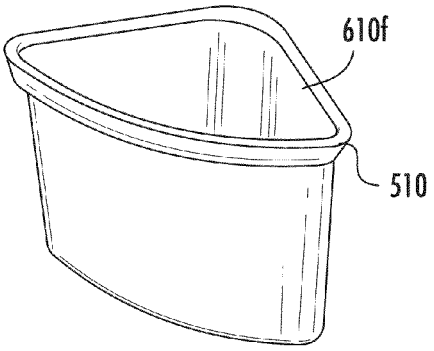

According to an exemplary embodiment shown in FIG. 30, an accessory shown as a recessed shelf 610*d* is disposed in (e.g., coupled to, engaged with, etc.) a frame 510. As shown, the frame 510 surrounds at least a portion of the recessed shelf 610. The recessed shelf 610*d* substantially conceals the inner surface and the tab of the frame 510, so as to provide a smooth, blended appearance. An outer surface of the frame 510 is exposed along a periphery of the recessed shelf 610*d* to provide additional aesthetic improvements to the storage system 300. According to another exemplary embodiment shown in FIG. 31, an accessory is shown as a recessed shelf 610*e* disposed in a frame 510. According to yet another exemplary embodiment shown in FIG. 32, an accessory is shown as a shower bin 610*f* disposed in a frame 510. Each of the various accessories shown in FIGS. 27-32 are configured to hold or store one or more bathing items, such as shampoo bottles, soap dispensers, soap bars, wash cloths, toys, or other types of bathing items.

Figure 33:
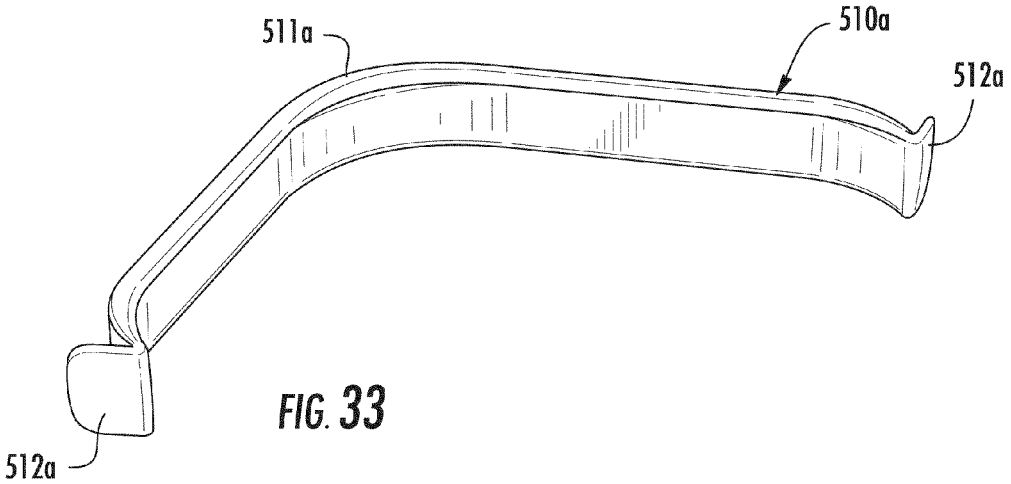
FIG. 33 is a perspective view of an accessory frame for use in the storage system of FIG. 4A, according to an exemplary embodiment.
Figure 34:
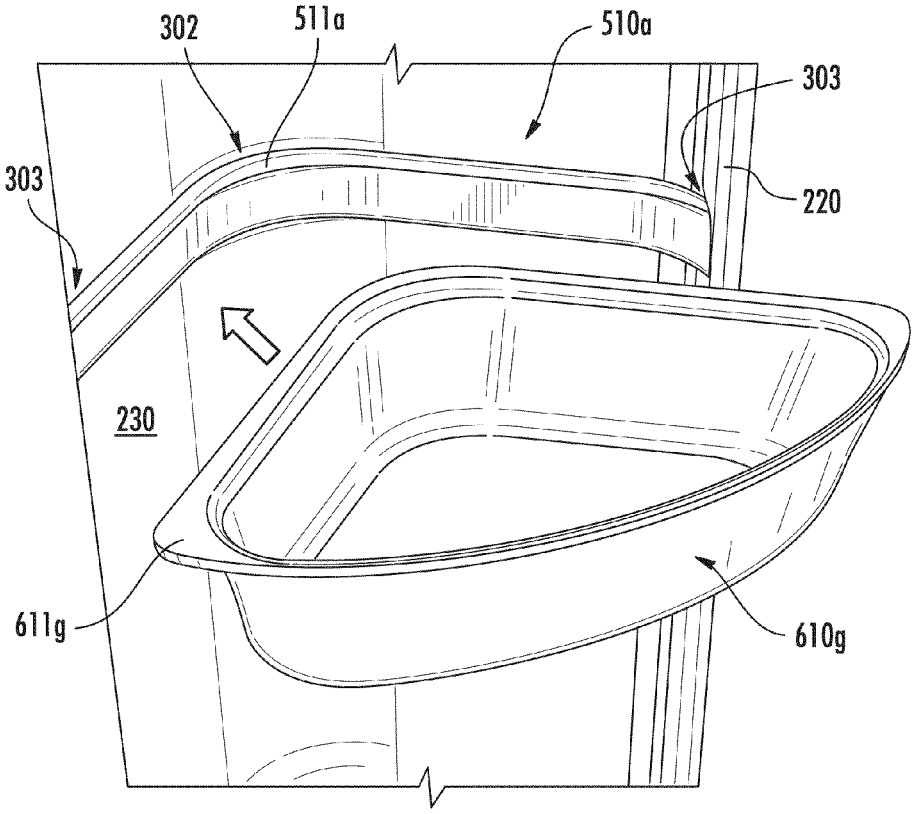
FIG. 34 illustrates the accessory frame of FIG. 33 and a receptacle being installed in the storage system of FIG. 4A, according to an exemplary embodiment.

Referring to FIGS. 33-34, a storage assembly including a frame member 510*a* is shown according to an exemplary embodiment. The frame member 510*a* is configured to be removably coupled to an installation zone defined by a corner notch 302 and a pair of side notches 303. The frame member 510*a* is further configured to receive a plurality of different receptacles or trays thereon, such as the receptacle 610*g* shown in FIG. 34. The frame member 510*a* includes a pair of flexible tabs 512*a* that are configured to flexibly engage the respective side notches 303 to removably couple the frame member 510*a* within the recessed portion of the storage system 300. Furthermore, the frame member 510*a* includes a rim portion 511*a* disposed at a rear corner thereof that is configured to engage a corner notch 302 of the recessed portion. In this way, the frame member 510*a* can be substantially supported in a vertical direction by the side notches 303 and the corner notch 202 along an installation zone.

As shown in FIG. 34, the frame member 510*a* is coupled at an installation zone within the storage system 300. The flexible tabs 512*a* are engaged with respective side notches 303 of the back wall panel 230 and the right end wall panel 220. Likewise, the rim 511*a* is engaged with the corner notch 302 of the back wall panel 230. An accessory shown as a receptacle 610*g* is shown being installed into the storage system 300. The receptacle 610*g* includes a rim 611*g* extending outwardly along an other peripheral edge of the receptacle at an upper portion thereof. The rim 611*g* is configured to engage at least a portion of the frame member 510*a* to support the receptacle 610*g* in a substantially vertical direction within the storage system 300. That is to say, an upper portion of the frame 511*a* extends outwardly from the recessed portion, and acts as a support surface for supporting the receptacle 610*g* within the storage system. The receptacle 610*g* can be easily removed from the frame member 510*a* by lifting the bin in an upward direction out of engagement with the frame member. According to various exemplary embodiments, a variety of different types of storage accessories can be coupled to the frame member 510*a* to provide different storage solutions.

Figure 35:
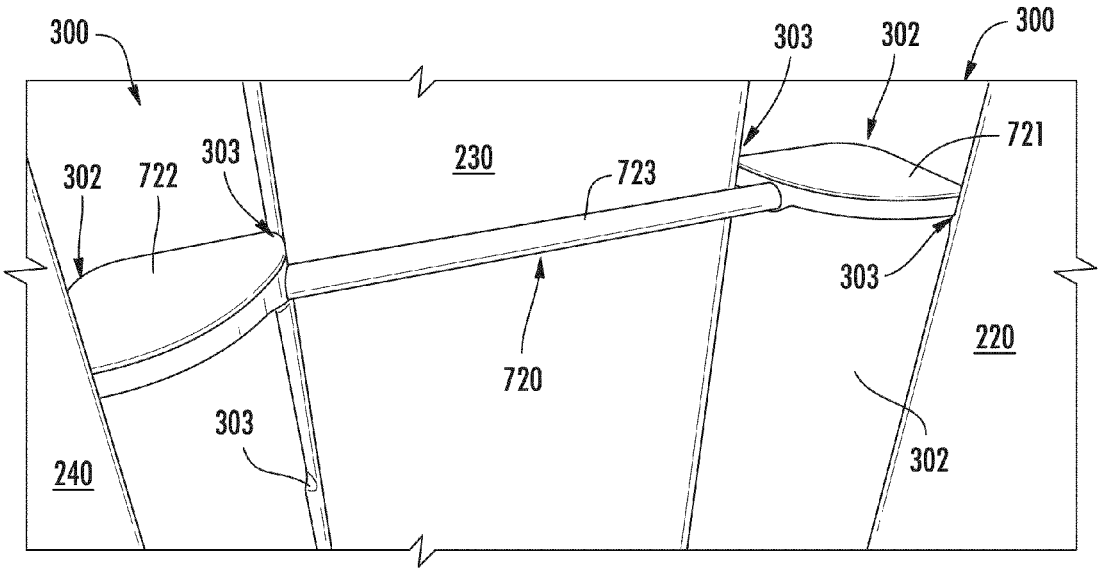
FIG. 35 is a perspective view of an accessory shown as a grab bar installed in the storage systems of FIG. 4A, according to an exemplary embodiment.

Referring now to FIG. 35, an accessory shown as a grab bar 720 is shown coupled within the shower enclosure of FIG. 4A according to an exemplary embodiment. The grab bar 720 can be selectively moved to different installation zones within the storage systems 300 to allow for reconfiguration of the shower or bathing area. As shown in FIG. 34, the grab bar 720 includes a right corner member 721 and a left corner member 722 coupled together by an elongated member 723. The right corner member 721 and the left corner member 722 each include a generally planar upper surface that can provide support for holding or storing one or more bathing items (e.g., soap, shampoo bottles, toys, etc.). Furthermore, the elongated member 723 can provide support for a user of the shower enclosure to assist the user with standing or moving around within the enclosure.

According to the exemplary embodiment shown, the right corner member 721 and the left corner member 722 are removably coupled within the recessed portions located at the rear corners of the shower enclosure, respectively. The right corner member 721 is coupled at an installation zone located between the back wall panel 230 and the right end wall panel 220. Likewise, the left corner member 722 is coupled at a separate installation zone located between the back wall panel 230 and the left end wall panel 240. The two installation zones are located at substantially the same height, such that the grab bar 720 is oriented in a substantially horizontal direction to provide a level support surface to, for example, assist a user with entering, exiting, or moving within the shower enclosure.

According to an exemplary embodiment, each of the right and left corner members 721 and 722 are configured similarly to the receptacle 310 discussed above, in that each of the corner members 721 and 722 includes one or more flexible tabs for engaging with respective side notches 303 of the recessed portions. The corner members 721 and 722 may also include a rim portion for engaging with the corner notches 302 at each installation zone. In this way, the right and left corner members 721 and 722 can be removably coupled within the two storage systems 300 at each corner of the shower enclosure. According to other exemplary embodiments, the right and left corner members 721 and 722 are made of a flexible material that can create an interference condition with one or more of the side notches 303 and the corner notches 302 to couple the grab bar 720 within the storage systems 300 (e.g., rubber, plastic, etc.). According to an exemplary embodiment, the grab bar 720 can be rotated by a user to couple the grab bar to the storage systems 300, such that the right and left corner members 721 and 722 can engage the respective side notches 303 and corner notch 302 at each installation zone.

The elongated member 723 is configured to support at least a portion of the weight of a user to, for example, assist the user with using the shower enclosure. According to an exemplary embodiment, the elongated member 723 is spaced apart from the back wall panel 230 to allow a user to grasp the elongated member 723 for support. The elongated member has a substantially hollow, cylindrical cross-sectional shape, although other cross-sectional shapes are possible, such as square, oval, octagonal, or the like, according to other exemplary embodiments.

According to an exemplary embodiment, the elongated member 723 is integrally formed with the right corner member 721 and the left corner member 722 at each end thereof. According to other exemplary embodiments, the elongated member 723 is coupled to each of the right and left corner members 721 and 722 (e.g., using fasteners, adhesives, etc.). The elongated member 723 can be made out of any rigid or semi-rigid material, or combinations of materials, such as metal, plastic, rubber, or the like, according to various exemplary embodiments. According to an exemplary embodiment, the elongated member 723 includes a grip portion to facilitate grabbing by a user. The grip portion can be a textured or knurled surface, a rubberized coating, or any other surface treatment.

Figure 36:
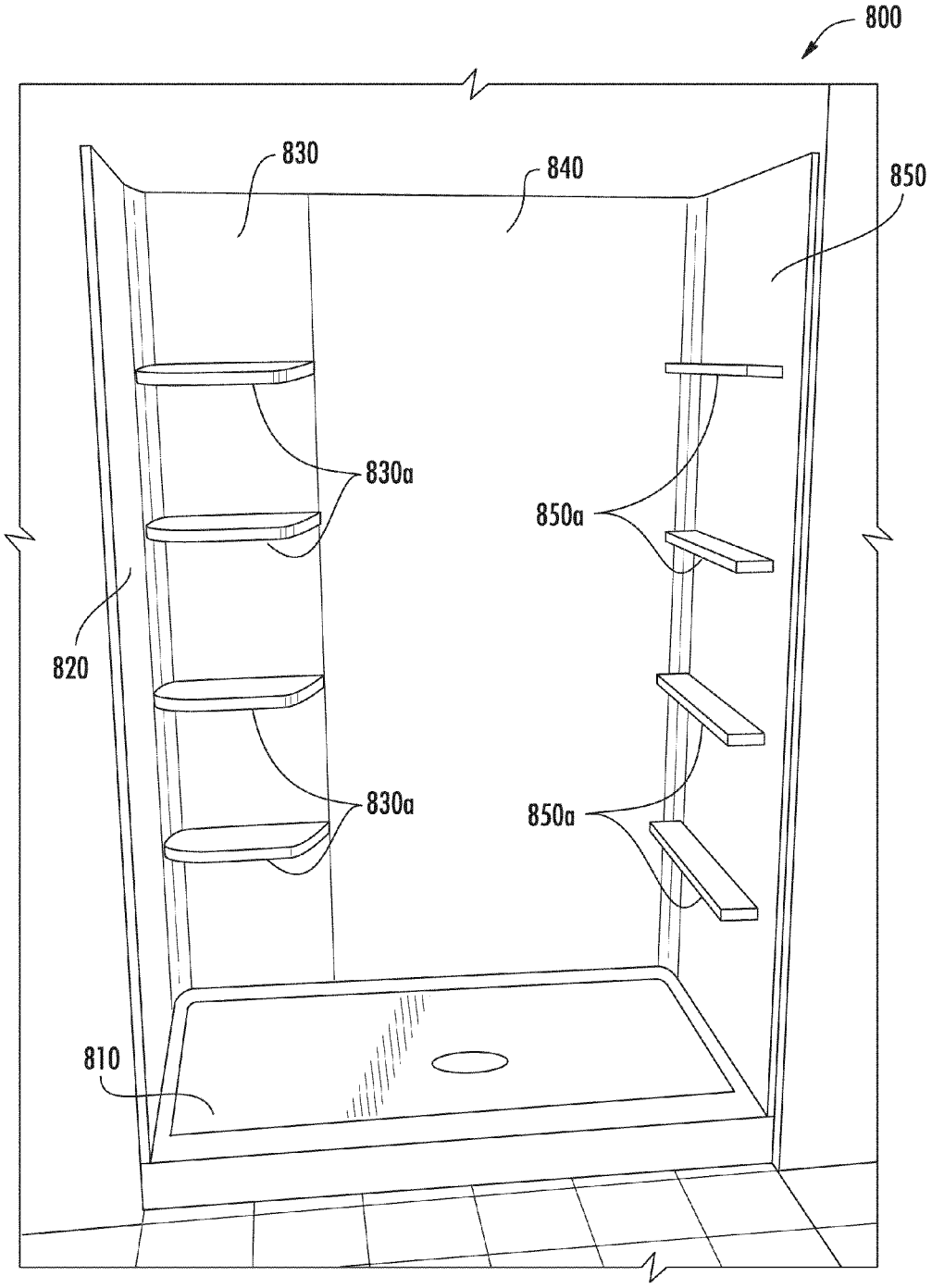
FIG. 36 is a perspective view of a modular shower assembly including integrated storage according to an exemplary embodiment.

Referring now to FIG. 36, a shower enclosure 800 is shown according to an exemplary embodiment. In the exemplary embodiment of FIG. 36, the shower enclosure 800 is a modular shower assembly including wall panels that can be swapped/exchanged with other wall panels having different configurations, such as having different storage configurations (e.g., shelves, compartments, etc.), different sizes, shapes, and the like. For example, according to an exemplary embodiment, a user/installer can remove a selected wall panel from the shower enclosure and exchange it for a different wall panel or combination of wall panels having a different configuration, such as a wall panel including additional integrated shelving or integrated storage compartments. In this way, the modular shower assembly provides for flexibility to a designer, user or an installer to customize the shower enclosure configuration to fit the needs of different users and different applications.

According to the exemplary embodiment of FIG. 36, the shower enclosure 800 includes a left end wall panel 820, a right end wall panel 850, a first back wall panel 830, and a second back wall panel 840 each coupled to a base shown as a receptor 810. The various wall panels are coupled together using, for example, any assembly features or methods for shower wall panels known to those skilled in the art (e.g., snap features, brackets, etc.). As shown in the exemplary embodiment of FIG. 36, the first back wall panel 830 includes one or more integrated storage accessories shown as shelves 830*a*. Similarly, the right end wall panel 850 includes one or more integrated storage accessories shown as shelves 850*a*. The shelves 830*a* and 850*a* can be molded-in features of the wall panels when they are manufactured (e.g., molded, etc.). According to an exemplary embodiment, each of the wall panels are made (e.g., molded, etc.) from, for example, a sheet molded compound (SMC) commercially available under the trade name Vikrell. According to other exemplary embodiments, the wall panels are made from another material suitable for the particular application in the shower enclosure 800.

Figure 37:
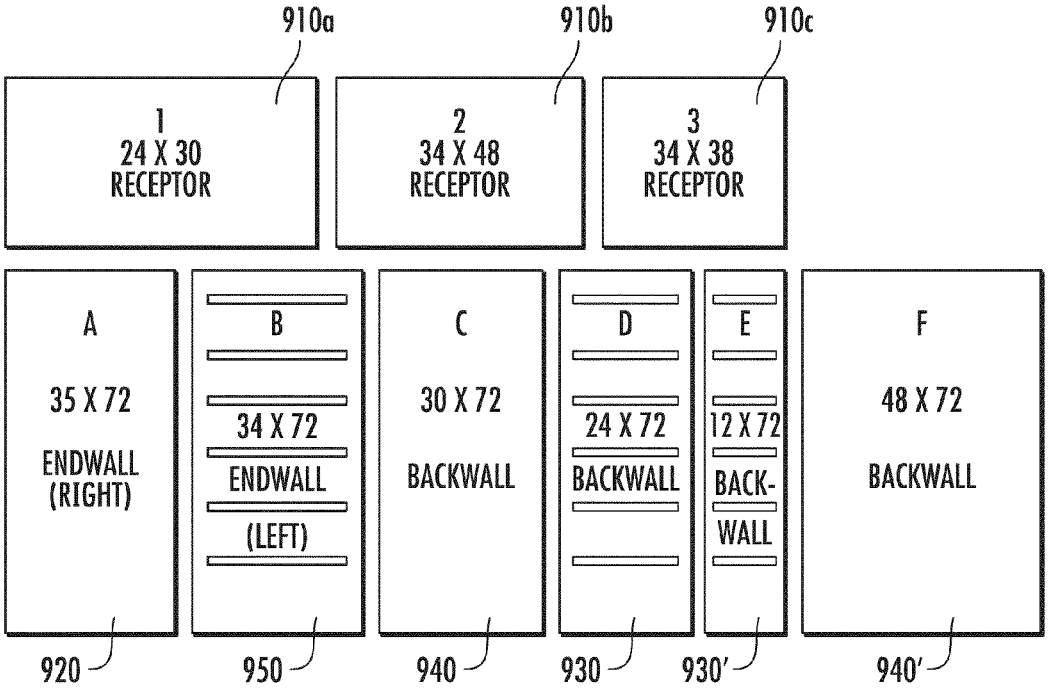
FIG. 37 is a schematic illustration of various modular shower walls for use in the modular shower wall assembly of FIG. 36.

Referring now to FIG. 37, various wall panels and receptors are shown for installation in the shower enclosure 800 according to various exemplary embodiments. According to an exemplary embodiment, the shower enclosure 800 can include a receptor 910*a* having a 24" (inch) by 30" (inch) footprint, a receptor 910*b* having a 34" (inch) by 48" (inch) footprint, or a receptor 910*c* having a 34" (inch) by 38" (inch) footprint, depending on the desired size and configuration of the shower enclosure 800. A user or an installer can select different combinations of wall panels each having a different configuration to create a custom shower enclosure. For example, according to the exemplary embodiment of FIG. 37, a user or an installer can select a right end wall 920 and a left end wall 950 each having a size of 34" (inches) by 72" (inches). The user or the installer can then select a back wall or a combination of back walls for the enclosure 800, such as a back wall 940 having a 30" (inch) by 72" (inch) footprint in combination with a back wall 930 having a 24" (inch) by 72" (inch) footprint, or alternatively, a back wall 940' having a 48" (inch) by 72" (inch) footprint in combination with a back wall 930' having a 12" (inch) by 72" (inch) footprint. In this way, a user, an installer, or a designer can create a custom shower enclosure having a custom configuration.

According to other exemplary embodiments (not shown), the shower enclosure 800 can have other configurations including other types of end walls and/or back walls having different sizes, shapes, integrated storage accessories (e.g., shelves, compartments, etc.), and the like, to enable an installer, a user, or a designer to create a custom shower enclosure configuration.

According to various exemplary embodiments, the different accessories disclosed herein can be made from a semi-rigid or a rigid material such as a plastic, a composite, or another type of semi-rigid or a rigid material, or combinations of materials, suitable for the particular application in the various shower storage systems. The materials may have a particular resiliency that facilitates reversibly bending certain portions of the accessory for engagement with and securement to other structures of the shower system (e.g. tabs, slots, hooks pockets, etc.). The various accessories can also include a surface treatment (e.g., paint, coating, etc.), such that the accessories are suitable for use in a shower or bathing environment.

Additional details and accessories for use in the various storage systems disclosed herein are available in U.S. Provisional Patent Application No. 62/015,214, filed on Jun. 20, 2014, entitled "SHOWER ACCESSORIES," the complete subject matter of which is incorporated by reference herein.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present application.

What is claimed is:

1. A storage system for a shower enclosure, comprising:

a first wall member including a corner defining a recessed portion, wherein the first wall member includes a corner notch disposed along the corner within the recessed portion, and a first side notch disposed along an inner side surface of the first wall member adjacent the recessed portion;

a second wall member coupled to the first wall member at an end of the corner adjacent the recessed portion and oriented perpendicular to the first wall member, wherein the second wall member includes a second side notch disposed along an inner side surface of the second wall member; and an accessory removably coupled between the first wall member and the second wall member at the corner notch, the first side notch, and the second side notch.

2. The storage system of claim 1, wherein the corner notch, the first side notch, and the second side notch are located at substantially the same height to cooperatively define a coplanar support surface for supporting the accessory in a vertical direction.

3. The storage system of claim 1, wherein the corner notch, the first side notch, and the second side notch are arranged in a triangular configuration.

4. The storage system of claim 1, wherein the accessory includes a flexible tab extending outwardly from an end of a front portion of the accessory, wherein the flexible tab is engaged with and received within the first side notch or the second side notch.

5. The storage system of claim 4, wherein the flexible tab is substantially constrained in a vertical direction via an interference condition between the flexible tab and the first side notch or the second side notch.

6. The storage system of claim 4, wherein the flexible tab is configured to be selectively disengaged from the first side notch or the second side notch by applying an upward force to the accessory below the flexible tab such that the flexible tab deflects away from the first side notch or the second side notch to remove the accessory from the storage system.

7. The storage system of claim 6, wherein the rim is configured to be selectively disengaged from the corner notch by applying an upward force to a bottom portion of the accessory below the rim to remove the accessory from the storage system.

8. The storage system of claim 1, wherein the accessory includes a rim extending along an outer periphery thereof, and wherein the rim is engaged with the corner notch.

9. A shower enclosure, comprising:

a back wall panel including a corner defining a recessed portion, wherein the back wall panel includes a plurality of corner notches stacked vertically along the corner within the recessed portion, and a plurality of first side notches stacked vertically along an inner side surface of the back wall panel adjacent the recessed portion; and a side wall panel coupled to the back wall panel at an end of the corner adjacent the recessed portion and oriented perpendicular to the back wall panel, wherein the side wall panel includes a plurality of second side notches stacked vertically along an inner side surface of the side wall panel adjacent the recessed portion;

wherein the plurality of corner notches, the plurality of first side notches, and the plurality of second side notches collectively define a plurality of separate installation zones configured to receive an accessory.

10. The shower enclosure of claim 9, wherein the plurality of first side notches and the plurality of second side notches are each stacked at substantially the same height as each of the plurality of corner notches to define a plurality of coplanar support surfaces each configured to support the accessory thereon.

11. The shower enclosure of claim 9, wherein at each installation zone a first side notch, a second side notch, and a corner notch are spaced apart and arranged in a triangular configuration.

12. The shower enclosure of claim 9, wherein the plurality of corner notches, the plurality of first side notches, and the plurality of second side notches are each spaced equidistant from each other.

13. The shower enclosure of claim 9, wherein the recessed portion extends in a longitudinal direction from a top of the back wall panel to a bottom of the back wall panel.

14. A storage system for a shower enclosure, comprising:

a back wall panel including a perpendicular corner defining a recessed portion, wherein the back wall panel includes a corner notch disposed along the corner within the recessed portion, and a first side notch disposed along an inner side surface of the back wall panel adjacent the recessed portion;

a side wall panel coupled to the back wall panel at an end of the corner adjacent the recessed portion and oriented perpendicular to the back wall panel, wherein the side wall panel includes a second side notch disposed along an inner side surface of the side wall panel opposite the first side notch; and an accessory removably coupled between the back wall panel and the side wall panel at the corner notch, the first side notch, and the second side notch.

15. The storage system of claim 14, wherein the corner notch, the first side notch, and the second side notch are located at substantially the same height to cooperatively define a coplanar support surface for supporting the accessory in a vertical direction within the shower enclosure.

16. The storage system of claim 14, wherein the corner notch, the first side notch, and the second side notch are arranged in a triangular configuration.

17. The storage system of claim 14, wherein the accessory includes a flexible tab extending outwardly from an end of a front portion of the accessory, and wherein the flexible tab is engaged with and received within the first side notch or the second side notch.

18. The storage system of claim 17, wherein the flexible tab is substantially constrained in a vertical direction via an interference condition between the flexible tab and the first side notch or the second side notch.

19. The storage system of claim 17, wherein the flexible tab is configured to be selectively disengaged from the first side notch or the second side notch by applying an upward force to a bottom portion of the accessory below the flexible tab such that the flexible tab flexes away from the first side notch or the second side notch to remove the accessory from the storage system.

20. The storage system of claim 14, wherein the accessory includes a rim extending along an outer periphery thereof, wherein the rim is engaged with the corner notch, and wherein the rim is configured to be selectively disengaged from the corner notch by applying an upward force to a bottom portion of the accessory below the rim to remove the accessory from the storage system.

* * * * *